US007823905B2

(12) United States Patent
Ritter

(10) Patent No.: US 7,823,905 B2
(45) Date of Patent: Nov. 2, 2010

(54) SPLITBOARD BINDINGS

(76) Inventor: William J Ritter, 49 Sunlight Ave., Bozeman, MT (US) 59718

( * ) Notice: Subject to any disclaimer, the term of this patent is extended or adjusted under 35 U.S.C. 154(b) by 580 days.

(21) Appl. No.: 11/409,860

(22) Filed: Apr. 24, 2006

(65) Prior Publication Data

US 2007/0216137 A1 Sep. 20, 2007

Related U.S. Application Data

(60) Provisional application No. 60/783,327, filed on Mar. 17, 2006, provisional application No. 60/792,231, filed on Apr. 14, 2006.

(51) Int. Cl.
*A63C 9/00* (2006.01)

(52) U.S. Cl. ..... 280/618; 280/603; 280/14.26

(58) Field of Classification Search ..... 280/601, 280/603, 614, 618, 624, 633, 14.21, 14.22, 280/14.26

See application file for complete search history.

(56) References Cited

U.S. PATENT DOCUMENTS

| | | | | |
|---|---|---|---|---|
| 3,061,325 | A * | 10/1962 | Glass | 280/613 |
| 5,035,443 | A | 7/1991 | Kincheloe | |
| 5,143,395 | A * | 9/1992 | Mayr | 280/602 |
| 5,143,397 | A * | 9/1992 | Stepanek et al. | 280/633 |
| 5,558,354 | A * | 9/1996 | Lion | 280/607 |
| 5,649,722 | A * | 7/1997 | Champlin | 280/818 |
| 5,660,416 | A * | 8/1997 | Schiele et al. | 280/818 |
| 5,697,631 | A * | 12/1997 | Ratzek et al. | 280/613 |
| 5,741,023 | A | 4/1998 | Schiele | |
| 5,765,854 | A * | 6/1998 | Moore et al. | 280/618 |
| 5,984,324 | A | 11/1999 | Wariakois | |
| 6,523,851 | B1 | 2/2003 | Maravetz | |
| 2004/0070176 | A1 | 4/2004 | Miller | |

FOREIGN PATENT DOCUMENTS

| | | |
|---|---|---|
| DE | 9108618 | 1/1992 |
| EP | 0362782 B1 | 8/1992 |
| EP | 0787512 B1 | 1/1997 |

(Continued)

OTHER PUBLICATIONS

Voile Backcountry Ski and Snowboard Equipment 97-98. (Voile, Salt Lake City UT). (2 pages) paragraphs 4,5: "The slider tracks slide onto . . . ", 1997-1998.

(Continued)

*Primary Examiner*—Frank B Vanaman
(74) *Attorney, Agent, or Firm*—Lambert Patent Services Group; K. Karel Lambert

(57) ABSTRACT

Improved boot bindings for backcountry splitboarding are disclosed. Each of a pair of soft-boot bindings has an integral boot binding lower that conjoins the two halves of a splitboard without the additional weight or height of an adaptor mounting plate and extra fasteners. Attached to the integral boot binding lower are the elements of a boot binding upper. The integral boot binding lower, in combination with upper boot bindings, provides improved torsional stiffness for splitboard riding. The integral boot binding lower further includes a toe pivot for free heel ski touring. The boot bindings can be readily detached from the ski touring position and reattached to the snowboard riding position, or vice versa, as is advantageous in backcountry touring and riding.

12 Claims, 15 Drawing Sheets

FOREIGN PATENT DOCUMENTS

| | | |
|---|---|---|
| WO | WO 93/14835 A1 | 8/1993 |
| WO | WO 98/17355 A1 | 4/1998 |

OTHER PUBLICATIONS

Nitro USA Snowboards Boardline 1993-1994 (Nitro USA, Seattle WA) (4 pages) p. 2 see photo, splitboard with ski-mode and snowboard-mode mounting assemblies, including slidably engageable conjoining bindings (see "instructions for Use" attached below). NitroUSA "Instructions for Use" (undated) p. 3 Riding position (Illustration [d]) ". . . slide the binding forward . . . ". Full text and illustrations.

Shoeboard Commercial Product—1 page description purportedly circa 2005, mini-ski binding with apparent adjustable toepiece and pivotable heel piece. Pivot located inferior to metatarsals at ball of foot. (As attested by B Kunzler Esq).

Shoeboard_BackPacking Light—1 page description dated 2006 from Back Packing Light On-Line product review.

Commercial Product Description—Early splitboard distributed circa 1991-1993 by Nitro USA of Seattle WA; with Fritschi AT bindings and interface. Annotated photographs 1-10. Author: K Karel Lambert.

* cited by examiner

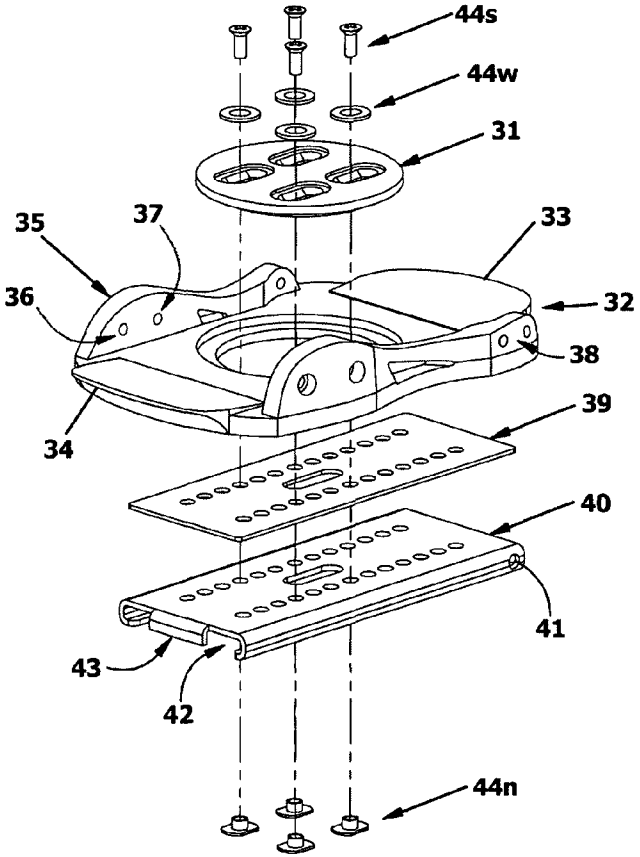
Fig. 4B (Prior Art)
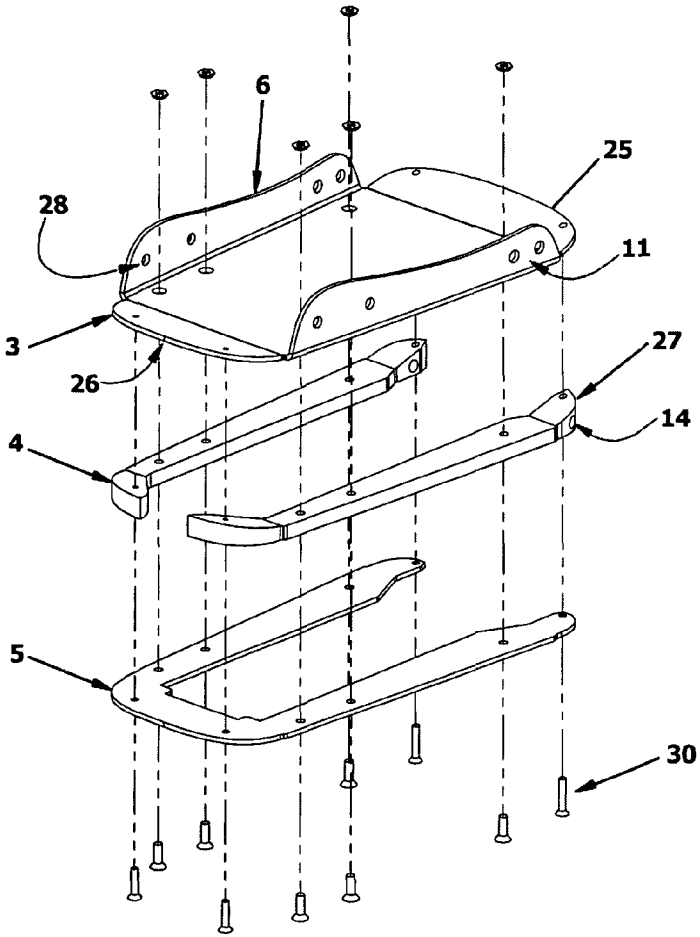
Fig. 4A (Example 1)

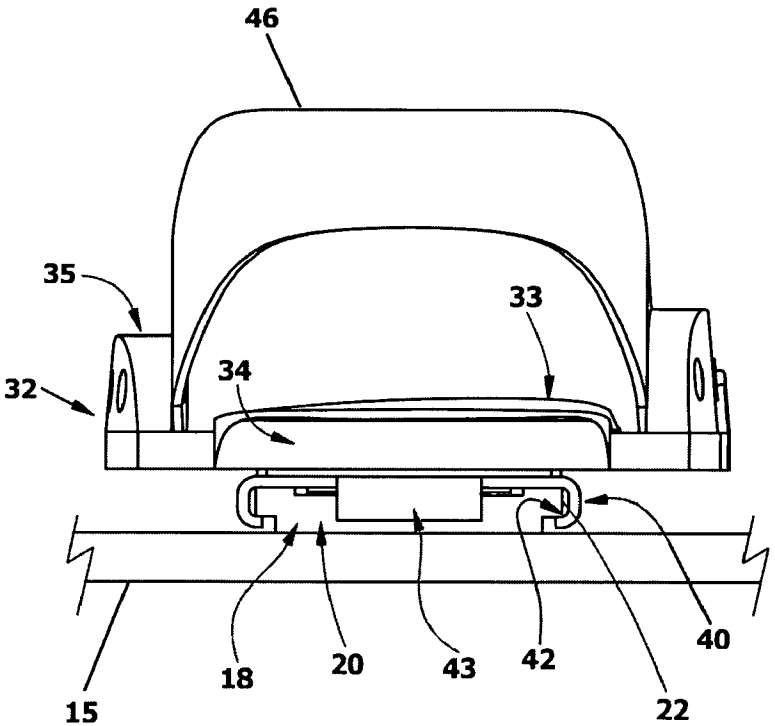
Fig. 5B (Prior Art)
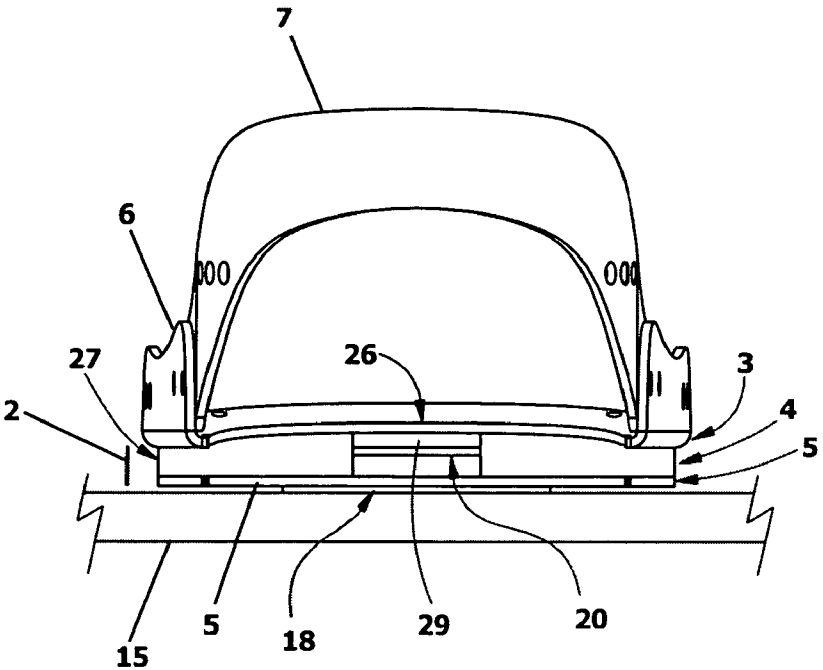
Fig. 5A (Example 1)

SPLITBOARD BINDINGS

RELATED APPLICATIONS

This application claims the benefit under 35 U.S.C. 119(e) of U.S. Provisional Patent Application No. 60/783,327 filed Mar. 17, 2006 and U.S. Provisional Patent Application No. 60/792,231 filed Apr 14, 2006, and these provisional applications are incorporated herein by reference in entirety.

BACKGROUND OF THE INVENTION

1. Field of the Invention

The invention relates generally to splitboards in Class 280/600 et seq. More particularly, the invention relates to a boot binding system that has improved torsional stiffness for use with splitboards and that gains its stiffness from an integral sandwich box girder construction which grippingly attaches to the snowboard mounting block assemblies.

2. Background of the Invention

Backcountry snowboarding appeals to riders who wish to ride untracked snow, avoid the crowds of commercial resorts, and spurn limitations on what and where they can ride. There are no ski-lifts in the backcountry, so the snowboarder must climb the slopes by physical effort. Some snowboarders simply carry their board and hike up, but progress can be almost impossible if the hiker sinks deep in soft snow. Travel efficiency can be improved with snowshoes, but the rider must still find a way to carry their board up the slope.

Saving effort is the name of the game in the backcountry; it determines how many runs a rider is going to make in a day. If a rider is exhausted by the time they reach the top of the run, they aren't going to snowboard to the best of their ability, or enjoy themselves as much as they could.

Splitboards are a recent improvement. When assembled, a splitboard looks like a snowboard, but can be taken apart to form a pair of skis. The right and left skis of a splitboard are asymmetrical; they are the mirror halves of a snowboard—longitudinally cut (or "split"), and typically have the sidecut (ie. nonlinear longitudinal edges) and camber of snowboards.

When touring cross-country and uphill to reach the slopes, the skis are worn separately. Cross-country travel on skis requires less effort than hiking or snowshoeing. Since the rider is wearing the skis instead of carrying a snowboard, the effort is less tiring—the rider can glide along, and there is no extra weight to carry up the slope. The wider track of the splitboard skis reduces sinking in soft powder snow.

"Free heel" ski bindings and adaptors, such as telemark, randonee or Alpine Trekkers, make ski touring easier. In addition, the skis may be adapted for climbing by applying climbing skins to the lower surface of the skis. The use of climbing bars propped under the boot heels aids in climbing steeper slopes and crampons may be used in icy conditions to decrease the risk of slipping. Free heel bindings, climbing skins, climbing bars and crampons are used by touring splitboarders as well.

In the occasional descent in ski touring mode, the heels of the boot bindings are either "locked down" to the skis, with descent using conventional alpine techniques, or more commonly left free with the toe attached by a pivot, with descent using telemark ski techniques.

The splitboard reveals its true utility on the downhill rides. The rider first joins the two skis of the split board pair to form a snowboard-like combination. The rider's stance in the snowboard riding configuration is sideways on the board, with legs spread for balance. Ideally, the rider descends the slope as if riding a snowboard, with heels and toes locked in place.

Some boards, known as "swallowtails", are designed specially for powder snow. These boards have forked tails that allow the tail of the board to carve more deeply in the snow while keeping the nose of the board high.

Another version of splitboards, recently innovated in Europe, is formed with two narrow skis and a third fitted plank between the skis. When ski touring, the extra plank must be carried. It remains to be seen whether this will catch on in backcountry snowboarding elsewhere.

It should be noted that downhill skiing and snowboard riding require very different styles and skills. With skis, the body points in the same direction as the skis, and the skier uses hips and knees to change direction. Knee injuries are common because the legs move separately. On a snowboard, the body is essentially crossways on the board, and both heels are firmly attached to the board so that the feet, ankles, hips, and upper body can be used to set the board on an edge and make a turn. Knees are more protected because both legs are firmly secured to the board.

Backcountry splitboarding, which combines ski touring and snowboarding, thus requires boot bindings adaptable for both ski configuration (ie. one to a ski) and for snowboard configuration, (ie. joining the skis as a snowboard).

In one widely used configuration of the prior art, snowboard mounting block elements (also termed toe and heel "pucks") are attached in pairs to the opposing ski member halves of the splitboard. Changing the position of the mounting blocks allows the rider to mount their bindings at the desired angles and positions along the length of the splitboard. These mounting blocks, disclosed in U.S. Pat. No. 5,984,324 to Wariakois and hereby incorporated in full by reference, are designed so that an adaptor mounting plate (see the C-channel, Item 74 of FIG. 6 of U.S. Pat. No. 5,984,324, also termed "slider plate") attached to the boot mounting assembly can be slid over the toe and heel snowboard mounting blocks, conjoining the ski members of the pair. The adaptor mounting plate adds about 7 oz (or 200 g) of weight to each boot. A rear stop tab on the adaptor mounting plate prevents the boots from sliding forward over the heel mounting block and a clevis pin is used to lock the toe of the adaptor mounting plate on the toe mounting blocks.

This same clevis pin is used as a pivot pin when the adaptor mounting plate is relocated to a ski mounting bracket. But experience has shown that the forces on the pivot pin are such that the pivot pin cradle and adaptor mounting plate of the prior art rapidly fatigue and are ovally deformed, leading to heel "fishtailing" in free heel mode, which destabilizes the rider and which must be repaired by replacement of the worn parts.

A second system for grippingly conjoining the ski member halves of a splitboard is disclosed in U.S. Pat. No. 6,523,851 to Maravetz, hereby incorporated in full by reference. This system employs a recessed ring with raised flanges that mate with a clamshell adaptor plate to secure the upper boot assembly to the board. The preset angle of the foot relative to the board can be changed by use of a locking pin in the rotatable lower half of the lower adaptor plate. The clamshell is hinged at the toe, but the heel can optionally be locked down. Conversion from touring mode to snowboard mode can be difficult with this system because snow often gets inside the clamshell works during touring, and consequently this system has proved less than satisfactory in field experience by snowboard riders.

Both of the above prior art splitboard systems employ the adaptor mounting plates to secure the boot bindings to the board interchangeably between ski and snowboard configurations. In addition to the ski member conjoining function, this approach teaches the utility of a universal mounting system for the industry-standard disk (3- or 4-hole) used in most snowboard boot mounting systems, strap or step-in, including hard, hybrid, or soft boots. An even more complex example of an adaptor plate is shown in US 20040070176 to Miller. Examples of other mechanisms that lack the required interchangeability include U.S. Pat. No. 5,035,443 to Kinchelee, U.S. Pat. No. 5,520,406 to Anderson, and U.S. Pat. No. 5,558,354 to Lion.

However, splitboarding is no longer a crossover sport. The majority of board riders have developed a preference for soft boots, which many find to be lighter, more comfortable, better adapted to the style of riding they prefer. Only a minority of riders use hard boots. Board riders typically prefer a greater range of motion at the ankle than hard boots provide. Flexibility at the ankle (also known as "foot roll") enhances the rider's ability to shift his or her weight and body position around the board for balance and control by allowing for a range of angles the legs can make with the board. For example in riding over a mogul, the rider shifts weight to the back of the board as the angle of the slope changes, or in carving a turn in hard snow, the rider will lean forward on the board. Flexibility may also improve the overall ride by allowing bumps to be more readily absorbed by the ankles and knees. Thus, the freedom of the foot to "roll", and allow the angle of the leg to change relative to the board, provides a performance and feel that many riders find desirable. Soft boots have emerged as a clear preference among splitboarders.

Boot bindings for use with soft boots are of two basic types: strap bindings and step-in bindings. A strap binding, which has been the traditional type of binding for a soft boot, includes one or more straps that are tightened across various portions of the boot, securing the boot in a boot pocket formed by the binding upper. For example, an ankle strap may be provided to hold down a rider's heel in the heel cup and a toe strap may be provided to hold the front portion of the rider's foot.

Step-in snowboard bindings, both toe-and-heel and sole side-grip, have also been developed for use with soft snowboard boots. Most of these require specially fabricated boots matched to the bindings. Newer innovations include high-back click locking mechanisms.

However, while innovation continues, the prior art has not produced a boot binding optimized for splitboarding. Multiple components of the prior art—for example, 4-hole disk bindings, adaptor mounting plates, rubber gaskets, and filled-nylon base plates-serve only to add weight and to put more height between the rider's heel and the board itself. Damaging metal fatigue of critical parts results from the design of the adaptor mounting plate and pivot pin cradle. The lack of firm broad contact between the most commonly sold adaptor mounting plate and the board surface also adds to the rider's instability.

Very importantly, and paradoxically, the added "flex" or "play" permitted by the engineering mechanics of the prior art adaptor mounting plates, which float above the surface of the board (see Example 2), results in dampening of the rider's movements with respect to the board and loss of control, an undesirable sensation. I have found that the paradox arises because, although freedom of movement of the ankle in the boot binding is essential to good riding, there must also be torsional stiffness—the rider's motions must be resisted by an optimal level of stiffness in the binding so that the legs cannot simply angle back and forth, but rather the binding resists this torsional motion (in the engineering sense) with a spring-like stiffness, allowing the rider to apply pressure at the desired segment along the length of the board.

The board is controlled by the bite of its edges in the snow. The rider steers by relocating pressure from one side of the board to the other as well as from nose to tail. Toeside and heelside turns on a snowboard involve a complex combination of dorsiflexion and plantar flexion, plus the roll of the calcaneus, talus, and subtalar joint, nosewise and tailwise on the board. While these motions would seem to be favored by a completely loose binding, in fact, an optimal torsional binding stiffness is required. Torsional stiffness is the spring force in the bindings that opposes the rider's motion. For every force, there is a force in the opposite direction. This opposing force translates the rider's motion into pressure on the desired section of the board. When the rider bends downslope, for example, the boot bindings transmit pressure onto the nose of the board. When the rider bends upslope, the boot bindings transmit pressure onto the tail of the board. Similar forces come into play as the rider leans toeside or heelside. If the bindings lack torsional stiffness, the ability to apply control pressure to the intended segment of the board is decreased. If the bindings are too stiff, the legs cannot pivot, and the rider loses balance and control. Therefore, there is an optimal stiffness, providing an optimal mix of freedom of motion and board control.

While hard ski boot bindings are too stiff to allow the range of motion most snowboarders prefer, the splitboard systems of the prior art incorporate a soft boot binding with an adaptor mounting plate that is not stiff enough. The rider can readily bend at the ankle, but cannot precisely transmit that force as a directed pressure at the desired segment of the board.

A problem addressed by this invention is thus one of enhancing the torsional stiffness of snowboard boot bindings for use with splitboards in "snowboard riding mode", and simultaneously improving performance and comfort of the equipment in free-heel "ski touring mode". There is an unmet need for dedicated splitboard soft boot bindings with stiffness, weight, and heel height designed for today's splitboard riding styles.

SUMMARY OF THE INVENTION

The most relevant teachings of the prior art focus on a boot binding with one or more adaptor mounting plates—so that boots and boot bindings designed for snowboarding can be adapted for use with splitboards. This approach is problematic, adding weight, instability, and decreasing the torsional stiffness (or spring constant) of the boot bindings. No solution has been offered in the prior art that eliminates the weight and height of the essentially ubiquitous "adaptor mounting plate" and, as recognized here, supplies the right amount of stiffness in the boot binding on the ankle to optimize rider control, while remaining comfortable and responsive for the soft boot rider.

Any solution must also allow the rider to easily reposition the boots when switching from snowboard riding to ski touring configuration, and the performance in ski touring configuration must also be improved.

I teach here that the prior art adaptor mounting plate, which serves the function of adapting both snowboard-type soft-boot bindings and hard boot bindings to the snowboard mounting blocks and also to the ski touring mounting brackets of the prior art, can be advantageously eliminated. The adaptor mounting plate, which is an essential component disclosed in single-embodiment patents such as U.S. Pat.

Nos. 5,984,324 and 6,523,851, can be replaced with a box girder, in which the box girder is integral to the boot binding lower. I have obtained stiffer torsional spring constants in the boot bindings through this method of construction. While not being bound by theory, this teaching is a new solution to the problem of boot binding structural mechanics, and is shown to have unexpected advantages that improve the snowboard ride.

Disclosed here are improved boot bindings optimized for splitboarding. By eliminating the adaptor mounting plate, and subsuming its functions as part of an integral boot binding lower, multiple improvements in form and function are achieved. Unneeded weight is eliminated (about 12 oz, or almost 400 gm) per pair of bindings. Reduction in heel height relative to the board surface results in a lower center of gravity on the board, for better balance and control. Removal of the adaptor mounting plate also increases the firmness of the foot and ankle contact with the board surface, and eliminates the looseness, flex, or "play" between the multiple mechanical components of the prior art that dampen the board's responsiveness to the rider's movements.

Surprisingly, free heel ski performance is also improved. For one, by replacing the pivot pin used with the prior art adaptor mounting plate with a longer pivot pin mounted through the structural girder at the toe of the integral boot binding lower, wear on the parts is dramatically reduced. In the preferred embodiment of Example 1, the pivot pin is lubricated and reinforced by ultrahigh molecular weight polyethylene (UHMWPE) used as the spacer material in the toe of the integral boot binding lower. This eliminates oval mounting-hole deformation characteristic of prior art pivot pin mounting cradles. Also, broader and more firm toe contact with the board is obtained, improving performance in telemark skiing. Snow, which invariably can pack up under the boots and mounting blocks during skiing and snowboarding, is vented out under the heel, easing the switch from ski touring to snowboard riding configuration, and vice versa.

As demonstrated here, control of the board is improved by eliminating cumulative elastic and inelastic deformation that is readily observable in boot adaptor fittings of the prior art (see Example 2), deformability that is attributable to the adaptor mounting plate, its associated hardware, and to flex in cantilevered elements of the base plate. Comparative field studies performed with embodiments of this invention show that the deformability problem clearly improved: the base of the boot is securely and broadly mounted to the board, and the torsional spring stiffness is increased, while maintaining the desired freedom of movement.

Thus these inventive improvements solve unmet needs in optimizing boot bindings for splitboarding: by eliminating the irksome adaptor mounting plate and 4-hole disk, by grippingly securing the rider's boots low on the board for a stable and comfortable ride, and by use of a box girder-type construction, in combination with a boot binding upper, that supplies the required torsional stiffness to the ankle.

The improved embodiments will now be described in more detail in the drawings and remaining disclosure.

BRIEF DESCRIPTION OF THE DRAWINGS

The drawings provide information concerning selected current-best embodiments of the invention and are therefore not to be considered limiting of the scope of the claims.

FIG. 4A is an exploded view of a sandwich box girder-type of boot binding of Example 1, with heel perspective. For comparison, FIG. 4B shows a boot binding of the prior art (per U.S. Pat. No. 5,984,324).

FIG. 5A is an elevation view of the heel of an inventive boot binding lower, with heel cup, of Example 1 in snowboard riding configuration. For comparison, FIG. 5B presents the same view of the heel of a boot binding of the prior art (per U.S. Pat. No. 5,984,324).

DETAILED DESCRIPTION OF THE INVENTION

1. Definitions

Figure 1:
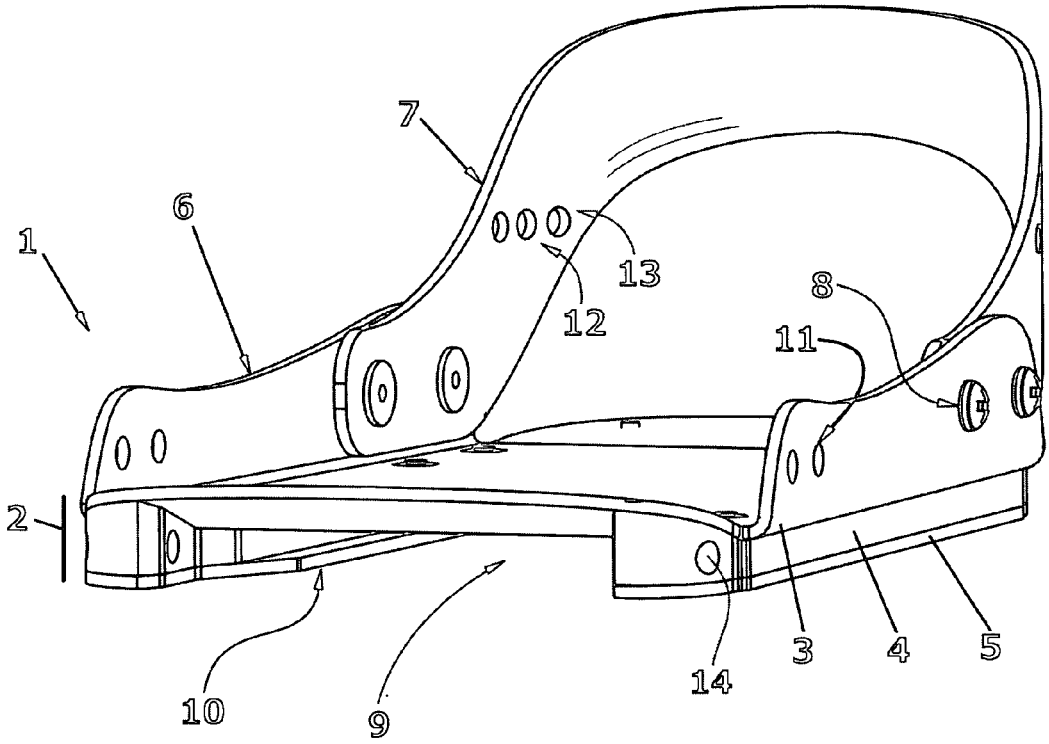
FIG. 1 is a perspective view of a sandwich box girder-type of boot binding lower with heel cup, the construction of which is described in Example 1.

Certain meanings are defined here as intended by the inventor, ie. they are intrinsic meanings. Other words and phrases used here take their meaning as consistent with usage as would be apparent to one skilled in the relevant arts. When cited works are incorporated by reference, any meaning or definition of a word in the reference that conflicts with or obscures the meaning as used here shall be considered idiosyncratic to said reference and not relevant to the meaning of the word as used in the present disclosure.

Board—a low-friction extended, generally planar surface intended for supporting a standing person while sliding over snow or ice, and selected from the group snowboard and splitboard.

Splitboard—a combination consisting of two separable ski members that can be joined at opposing lateral edges to form a snowboard. The ski members are typically shaped so as to approximate the right and left halves of a snowboard respectively. The tips of the ski members are generally secured together in the snowboard configuration by use of hooks and pins, or the like, but the relative stiffness of the coupling is largely the result of the mechanics of the transverse union formed by the boot bindings straddling the separate ski members.

Boots—are of three general types, i.e., hard boots, soft boots and hybrid boots (for example "plastic mountain boots") which combine various attributes of both hard and soft boots. Hard boots are exemplified by alpine and telemark ski boots and typically employ a moderately stiff or very stiff molded plastic shell for encasing a rider's foot and lower leg with minimal foot movement allowed by the boot. Hard boots conventionally are secured to the board using plate bindings that include front and rear bails or clips that engage the toe and heel portions of the boot.

Soft boots, as the name suggests, typically are comprised of softer materials that are more flexible than the plastic shell of a hard boot. Soft boots are generally more comfortable and easier to walk in than hard boots, and are generally favored by riders that engage in recreational, "freestyle" or trick-oriented snowboarding, or alpine riding involving both carving and jumping. Soft boots are conventionally secured to the board with either a strap binding, a step-in binding with lateral clamp (such as US 20020089150), or with the flow-in bindings, clickers, or cinches of hybrid bindings known in the art (such as U.S. Pat. No. 5,918,897 to Hansen and U.S. Pat. No. 6,173,510 to Zanco).

Ski tour or touring—When used as a noun, indicates: a trip through areas typically away from ski resorts, referred to as the backcountry, which may include traversing flat areas, ascending inclined slopes and descending slopes using one or several of the following pieces of equipment: skis, poles, snowshoes, snowboards, or splitboards. When used as a verb, indicates: to enter the backcountry, typically away from a ski resort, and perform one or more of the following: traverse flat areas, ascend inclined slopes, and descend slopes using one or more of the following pieces of equipment: skis, poles, snowshoes, snowboards, or splitboards.

"Ride" or riding—a noun or verb used by snowboarders to indicate the distinctive downhill riding experienced by a rider on a snowboard (or on a splitboard in snowboard mode). Snowboarders ride, skiers ski.

Ski touring configuration or mode—indicates a configuration in which the two ski members are separate and are attached one to a leg, typically with a free heel binding to facilitate traversing terrain and ascending slopes. When used to describe a splitboard configuration, indicates that the ski halves have been separated and the rider is ski touring on the separate ski members attached to each foot.

Ski mounting assembly—refers to hardware, brackets or blocks secured on the surface of each ski, generally centrally placed, so that boot bindings can be fastened to them, one boot to a ski, in the ski touring mode or position. In the most common device, a ski touring pin cradle is used with a pivot pin or pins with the pivot axis extending through the toe of the boot binding, the purpose of which is to provide a hinged coupling between the boot and its counterpart ski member, as in telemark skiing and "free heel" skiing. A ski mounting block may take the place of the pin cradle and may be used with boot mounting tongues, cables, or other pivoting means. Bushings may be used to extend the life of the wearing surfaces. Incorporated herein by reference with respect to pivoting means are U.S. Pat. No. 5,649,722 to Champlin, U.S. Pat. No. 6,685,213 to Hauglin, US 20050115116 to Pedersen, U.S. Pat. No. 5,741,023 to Schiele, and their references cited.

Herein, where a means for a function is described, it should be understood that the scope of the invention is not limited to the mode or modes illustrated in the drawings alone, but also encompasses other means commonly known in the art at the time of filing and other means for performing the equivalent function that are noted or cited in this specification.

Snowboard riding configuration or mode—indicates a configuration in which the right and left ski members are joined at opposing lateral edges to form a snowboard and the rider mounts the board with both feet spaced and secured in the snowboard mounting block assemblies.

Snowboard mounting block assembly—refers to prior art flanged mounting block elements secured to the ski members of a splitboard so that they can be conjoiningly and flangedly interlocked in the snowboard configuration by extending the boot bindings across them. For example, the snowboard mounting block assemblies of FIG. 2 and FIG. 6, as illustrated here, are derived from the prior art (See U.S. Pat. No. 5,984,324). In practice, paired snowboard mounting blocks are proximately positioned on the opposing ski members to, forming a "slider track" to receive a boot binding traversing the two ski members. The snowboard mounting block assembly elements are thus positioned to extend the boot bindings from one ski member to the other conjoining the ski members in the form of a snowboard.

Integral boot binding lower—refers to a sandwich box girder forming the base plate and the lower aspect of a boot binding (or of each of a pair of boot bindings), and having a top plate, bottom plate, medial web, lateral web, and ends modified for the heel and toe, where the web is made of a structural spacer material or "core", laminated, molded, glued, solvent-welded, or affixed between the top and bottom plates, and the bottom plate is formed as a flanged box-ended channel capable of receiving and flangedly interlocking or conjoining the two snowboard mounting block assemblies, one front of center (anteriorly placed) and one back of center (posteriorly placed) on the conjoined ski members in the snowboard riding mode. The integral boot binding lower may include formed elements such as side rails for securing the boot, a heel cup, a heel brace or highback, brackets for attaching straps, a toe riser, or other elements formed from the materials that make up the integral boot binding lower. In the snowboard riding mode, the boot heels are generally secured to the board. Provision is also made in the integral boot binding lower for the "free heel" ski touring mode by providing a pivoting means at the toe for attaching the boot binding to the ski mounting assembly. Integral boot binding lowers may be fabricated from sheet metal plates, such as aluminum or aluminum alloys, or from reinforced plastic plates, either molded or extruded. Ultrahigh molecular weight polyethylene is a preferred material for the spacer material forming the webs because of its toughness, resistance to wear, and lightness, but other thermoplastics such as nylon, polypropylene, Teflon, and polyamides or reinforced composites such as polyester fiber, carbon fiber, polyamide fiber, filled nylon, or aramid fiber thermosets may also be suitable.

Upper boot binding, or boot binding upper—refers to elements of a boot binding attached to an integral boot binding lower with fasteners or molded in place, and generally includes shaped supports that contact and secure the boot, for example a highback which may be foldable, a heel cup, rails, and one or more straps, most commonly a heel strap and a toe strap. The upper may also include a toe riser, shell, cushioning, and components that are engaged when the boot is inserted. These elements are generally formed of assemblies separable and distinct from the integral boot binding lower, for example various aluminum, titanium, and steel alloys (used in hardware, ratchets, heelcups, cables, baseplates, highbacks, etc), neoprene rubber, silicon rubber, low density polyethylene, polypropylene, fiberglass, nylon, filled nylon, leather, fabrics, stitching, EVA foam padded cores, and the like. The upper elements provide stiffness to the boot binding when attached to a rigid integral boot binding lower and thus contribute to the torsional stiffness of the boot binding as a whole. Selected upper elements are typically adjustable, such as the heel cup, allowing fitting for boot size and personal adjustment within the underlying limits of the design.

Receiving and grippedly conjoining—refers here to the action of slidingly and reversibly engaging a snowboard mounting block assembly or "slider track" with the adaptor mounting plate of the prior art or by a box girder with box-ended channel and internal flanges so as to conjoin two ski members in snowboard riding configuration. In the inventive device of Example 1, the box-ended channel formed in the base plate of the integral boot binding lower flangedly interlocks with flanged surfaces of the snowboard mounting block assembly. In a preferred embodiment, the box end of the box-ended channel prevents the integral boot binding lower from slipping over the snowboard mounting block elements from the heel. A transverse pin or other locking means may be used to secure the boot bindings at the open end of the box-ended channel at the toe. When this locking means is opened, the boot bindings may be slidingly removed from the snowboard mounting block assembly.

Adaptor mounting plate—refers to an intermediate mechanical device of the prior art for securing a 3- or 4-hole disk-mounted boot binding to the snowboard mounting blocks and ski touring tabs on a ski, snowboard, or splitboard. In its preferred configuration, the adaptor mounting plate, or "slider plate", consists of a C-channel constructed of heavy aluminum alloy plate. Clamshell adaptor plates have also been used.

4-hole disk—a component of a standard board binding of the prior art that mechanically couples the body of the binding base plate to the board. This disc is circular and can be rotatingly coupled to the binding, thus allowing the rider to select an angle of placement for each foot with respect the longitudinal axis of the board. Three-hole disks have also been used.

Torsional stiffness—in its simplest engineering analysis, torsional stiffness can be approximated by a form of Hooke's law relating torque to deformation:

$$T=K*\Delta\theta$$

where T is torque, K is a spring constant, and $\Delta\theta$ (theta) is the angular deformation or displacement relative to the heel pivot. A more complex model including elastic shear modulus, loss shear modulus, and dampening coefficients may also be formulated.

Foot roll—is a term used in the art to denote the freedom of angular leg movement experienced by a board rider. The rider uses foot roll to shift the pressure or "bite" of the board on the underlying snow. Foot roll is essentially the "$\Delta\theta$" in the equation for torsional stiffness.

Highback—An element that extends from the heel up the calf in part, and serves as an ankle brace to control the heel and leaning on turns, and can be rigid, semirigid, or flexible. The highback can also used to secure the boot into the boot binding upper in some step-in boot bindings. Highbacks typically have a pivot that allows them to be laid flat, decreasing the amount of storage space needed for the boot bindings.

2. Detailed Description

Two groups of drawings will be discussed. In the first section, FIGS. 1-8, the engineering of an integral boot binding lower in snowboard riding mode will be described. In the second section, FIGS. 9-18 describe the workings of the integral boot binding lower in ski touring mode. FIG. 19 illustrates assembly of some of the common features of an upper boot binding typical of marketable products of the present invention.

Referring now to FIG. 1, this perspective view shows an integral boot binding lower (1) with sandwich box girder (2) construction based on the current working prototype of Example 1. The box girder consists of three material layers: a top plate (3), a bottom plate (5), and a center spacer or core (4) that serves as the side webs of the girder. The box girder may be tapered or untapered.

The top plate and bottom plate shown in this illustration are made of sheet metal as described in Example 1, but may also be made of reinforced plastic composites, either as molded or extruded sheets. As shown in this embodiment, folded tabs of the top plate form side rails (6). An optional heel cup (7) may be fastened to the top plate rails. Provision for attachment of a toe strap (11), heel strap (12), and highback (13) are also illustrated. A single hole may be used for both the highback and heel strap.

The spacer or core web material of the girder is preferably a lightweight material, but carries both compression, tensile, and bearing loads. The material, such as a plastic, is characteristically tough and can be machined, drilled or molded.

Box-ended channel (9) and bottom plate internal flanges (10) form a gripping means that joins the sandwich box girder to mated snowboard mounting blocks inserted in the box-ended channel. Thus FIG. 1 demonstrates several structural elements of this embodiment, the sandwich box girder with side webs, the box-ended channel, and also a means for pivoting the structure at the toe, here indicated by a the transverse axial hole (14) for insertion of a toe pivot pin as described in FIG. 9 and FIG. 20. The toe pivot pin serves a dual function, also to lock the box-ended channel in place as will be shown in FIG. 2.

The integral boot binding lower provides rigidity in joining the two ski members, but also must provide a rigid platform for the boot bindings that secure the boot to the board. Without adequate stiffness in the integral boot binding lower, the torsional stiffness of the upper boot bindings will be correspondingly insufficient.

Note that in the prototype of Example 1, the adaptor mounting plate of FIG. 4B is absent, and there is an integration of the splitboard joining device (here a sandwich box girder, see FIG. 2 and FIG. 8) with a boot binding device (or boot binding upper) as in FIG. 19.

The integral boot binding lower is fitted with a boot binding upper. The purpose of the boot binding upper is to further secure the boot to the base plate and to provide freedom of motion with the required level of torsional stiffness. Upper bindings include heel cup, toe strap, heel strap, or step-in binding. Optional features such as padded rails, arch support, toe riser, heel cushion, heel riser, base plate, anti-slip plate, and exterior shell may be provided. A boot binding upper, the form of which can be highly varied and examples of which are well known in the prior art, is shown for example in FIG. 19. Selected elements of the boot binding upper, such as straps or step-in bindings, provide adjustments for fit and aid in establishing torsional stiffness.

Figure 2:
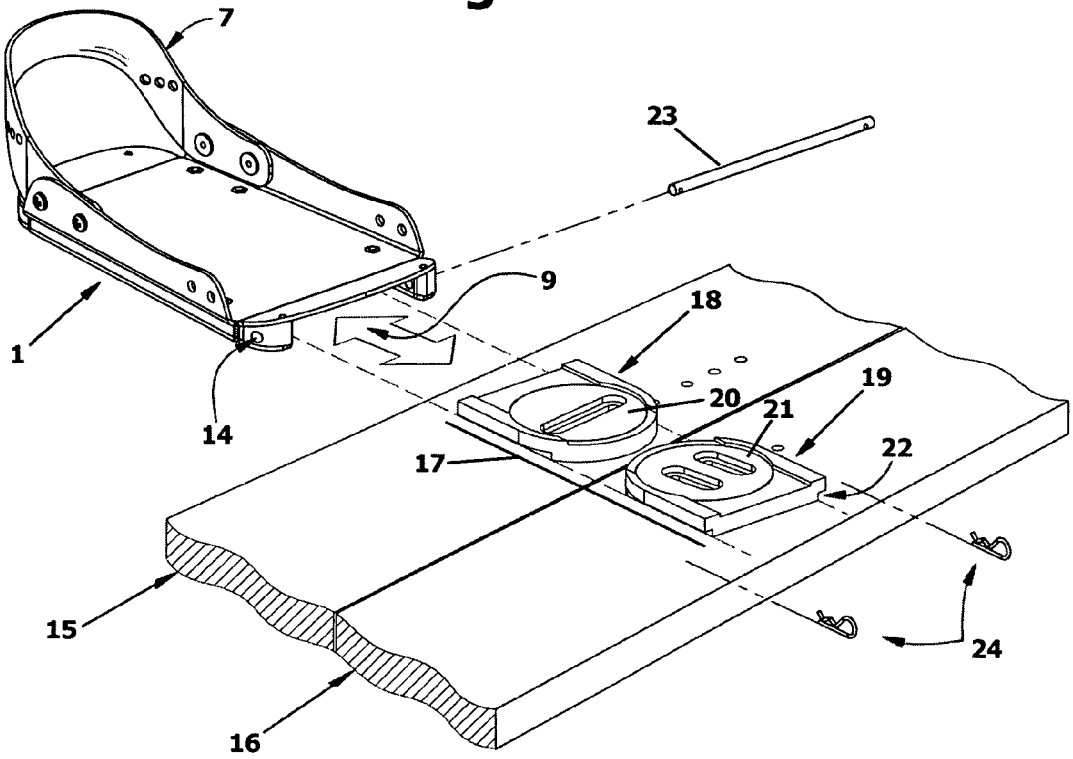
FIG. 2 is a perspective view of an inventive boot binding lower with heel cup. The double arrow indicates direction of movement as the boot binding lower slides onto the snowboard boot mounting assembly for use in snowboard riding configuration.

The bottom plate shown here is machined to form a box-ended channel (9) with internal flanges (10). The box-ended channel is open under the toe end of the box girder, but does not extend all the way to the heel, so as to capture the snowboard mounting block assembly. This function of the box-ended channel is illustrated in FIG. 2. The double arrow shows how the box-ended channel slidingly receives and engages a snowboard mounting block assembly (17) so that the internal flanges of the integral boot binding lower grippingly conjoin the flanges (22) of the snowboard mounting block elements (18, 19), the elements becoming flangedly interlocked. Note that the flanges of the two mounting block elements that make up the snowboard mounting block assembly are parallel and aligned for engaging the internal flanges of the box-ended channel.

When the boot binding flanges (10) extend under both snowboard mounting blocks (18, 19), the two ski members (15, 16) are rigidly conjoined. A toe locking pin (23) inserted at (14) prevents the assembly from slipping and is held in place with snaps (24). Thus in snowboard riding configuration, the sandwich box girder (1) traverses or "straddles" the pair of skis, and flangedly interlocks them in the form of a snowboard, also fixing the boot heel in place. Optional heel cup 7 is shown here for clarity. The rigidity of the underlying girder, its contact with the board surface and low profile, ensures a solid platform for the rider's boots and the boot binding upper.

A pair of internal pucks (20, 21) are supplied with fasteners for securing the pair of snowboard mounting blocks (18, 19) to the pair of ski members (15, 16), and permit adjustment and alignment for individual fit. The snowboard mounting block assembly (17) is adjusted to the preferred stance or angular orientation of the user and, in one embodiment, may be set up for the position of the user's feet in either a left-foot-forward or a right-foot-forward mode.

Figure 3:
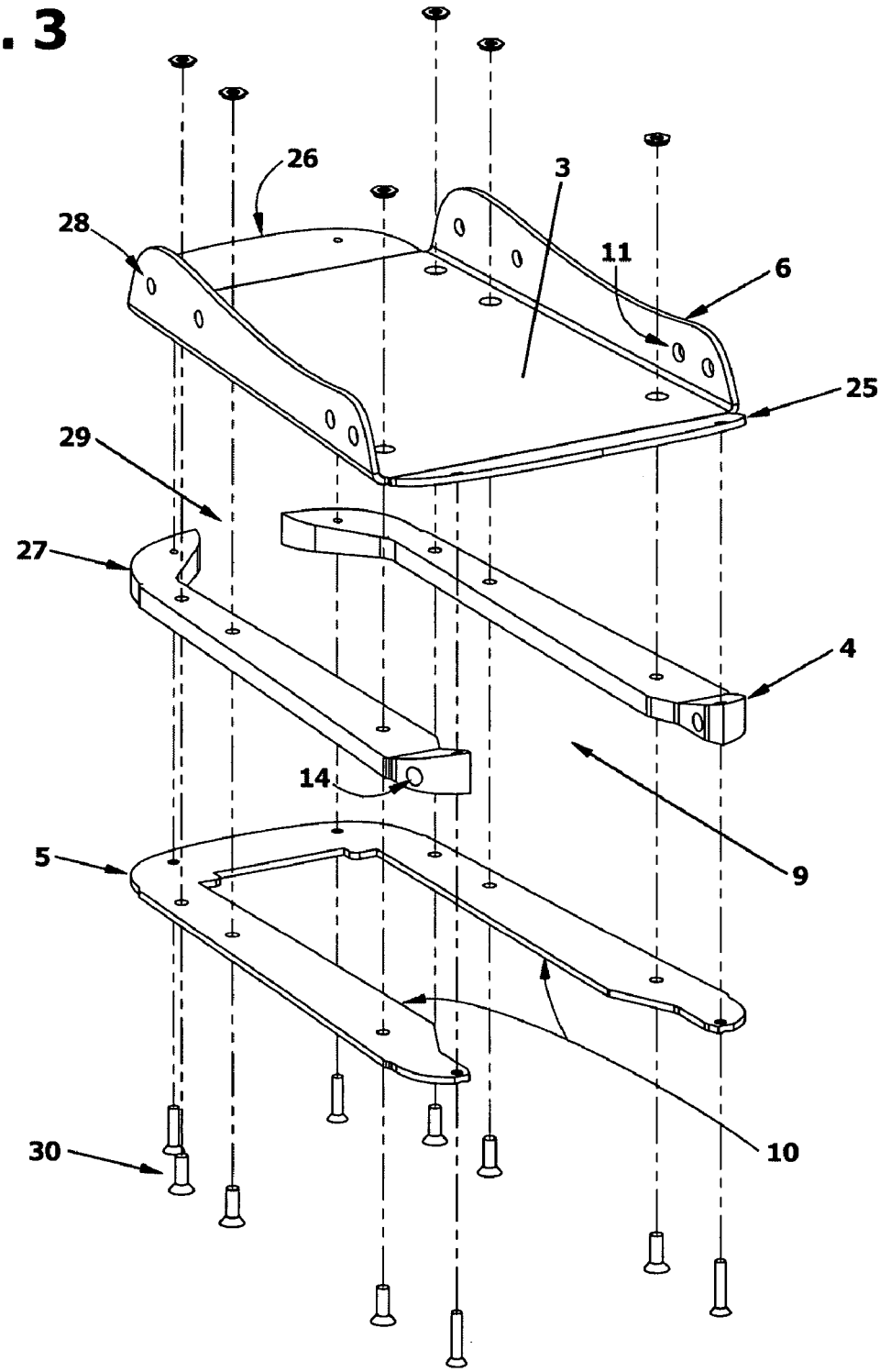
FIG. 3 is an exploded view of a sandwich box girder-type of boot binding lower, with frontal perspective.

FIG. 3 is a construction detail of the integral boot binding assembly of Example 1. Three mechanical elements, the top plate (3), spacer webs (4, 27) and bottom plate (5), are clearly shown as forming a sandwich box girder. In this view, the box-ended channel (9, directional arrow) is shown under the toe riser (25) and between the lateral and medial web (4, 27). Correspondingly, a snow vent (29, directional arrow) is formed under the heel riser (26) between the medial and lateral spacers (4, 27). The web elements are fitted or molded to the top and bottom plates, and the truss-like character of the box girder is strengthened by multiple fasteners (30) extending through the sandwich. Adhesives, lamination, or solvent welding may also be used to form the sandwich box girder, eliminating the need for fasteners.

Also adding to the truss character are the upward-folding side rails of the top plate (6). The top plate may also be used to make provision for attachment of elements of the boot binding upper with fasteners. Provision for a toe strap is provided at 11, and for a heel cup at 28 on the optional top plate side tabs (6).

FIGS. 4 and 5 provide comparative views of the embodiment of Example 1 with a boot binding of the prior art.

FIG. 4A again shows the basic construction of the integral boot binding lower of Example 1, but from a heel view. Shown are the three elements of the sandwich box girder: top plate (3), middle spacers (4, 27), and bottom plate (5), with fasteners (30).

For comparison, a prior art design is shown in the accompanying panel, FIG. 4B. In this side-by-side exploded view, the differences are readily seen between the inventive sandwich box girder of Example 1 and the prior art design of U.S. Pat. No. 5,984,324.

An essential element of the most popular prior art design is the adaptor mounting plate (40), which is an anodized C-channel formed from aluminum alloy. This adaptor mounting plate has flanges (42) that grippingly conjoin the snowboard mounting block assembly (as shown in elevation in FIG. 5B). The prior art assembly also dictates a 4-hole disk (31) used as a universal mount for the sort of soft boot binding upper base plate illustrated here by 32. Provision is made here for boot straps (38, 37) and for a heel cup (36) on side rails 35. The boot binding upper is fitted individually per foot, shown here with a left toe riser (33) and a heel riser (34). By industry standard, the 4-hole disk fasteners (44*s*, 44*w*) are at 4 cm corners. Tee nuts (44*n*) are used to secure the boot binding to the adaptor mounting plate. A gasket (39) is used to fit the boot binding upper (32) to the adaptor mounting plate (40). Note the heel stop tab (43) and the toe pivot axis (41), two areas where the adaptor mounting plate is very prone to metal fatigue.

In the prototype of Example 1 (compare FIG. 4A with FIG. 4B), the adaptor mounting plate has been eliminated. An integrated boot binding lower, the sandwich box girder, takes its place. The box girder serves in snowboard configuration both as a means to conjoin the two ski members and as a means to provide a rigid platform for supporting the elements of the boot binding upper. However, the design has other advantages as well, as become apparent by comparison.

FIG. 5B is an elevation view of the heel of the prior art boot binding with adaptor mounting plate (40) mounted in snowboard riding configuration. The flanges of the C-channel can be seen gripping mated flanges (22) on the filled nylon snowboard mounting block element (18). Also visible is a puck assembly (20), although the inner assemblies are obscured by the heel stop tab (43).

The base of the soft boot binding upper (32), side rail (35) and an optional heel cup (46) can also be seen in this view. The heel riser (34) partially obscures the toe riser (33), which is higher for the left big toe. Boot bindings optionally may be designed to accept only a left or right foot, or may be interchangeable.

Note the height of the base plate above the upper board surface (15) and compare with FIG. 5A, which is an elevation view of the heel of the embodiment of Example 1. The play of mechanical elements 18, 20, 22, 42, 40, 39 and 32 of FIG. 5B is eliminated in the design of FIG. 5A. In FIG. 5A, elements 18, 20, and 22 connect directly with the boot binding lower elements 5 and 10, and the rest of the structure is rigidly formed around those impinging flanges. Allowing for normal clearances, the bottom plate of the box girder is in contact with the upper surface of the board.

FIG. 5A again also shows the presently preferred sandwich construction (2) of bottom plate (5), web (4) and top plate (3). Side rails (6) and heel cup (7) provide added strength.

Visible under the heel riser (26) is an open space above puck (20) and bounded on the left and right by the webs (4, 27). This gap is the snow vent (29), which keeps the mechanism free of impacted snow.

Figure 6:
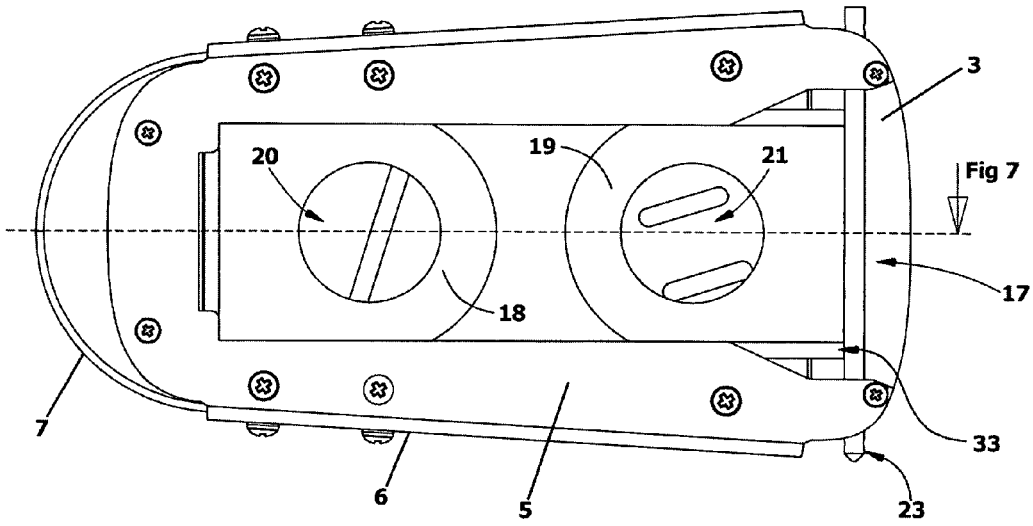
FIG. 6 is a plan view drawn from the underside of an inventive boot binding.

FIG. 6 views the construction of the box girder from the underside. The bottom plate (5) is observed to overlap flanges (33) on the snowboard mounting block elements (18, 19) of the snowboard mounting block assembly (17). The pucks (20, 21) engage the surface of the board which attaches to this underside (hardware not shown).

The side rail (6) of the top plate (3) is also visible, as is the band of metal forming the heel cup (7). The cutout in the profile of the bottom plate at the inside heel edge of the box-ended channel is designed for the heel rest of a commercially available ski mounting assembly design, as will be described in FIGS. 12 and 14. The snowboard mounting blocks are chocked against the heel crossbeam of the bottom plate, and are locked from forward motion by the toe pivot and locking pin 23.

Figure 7:
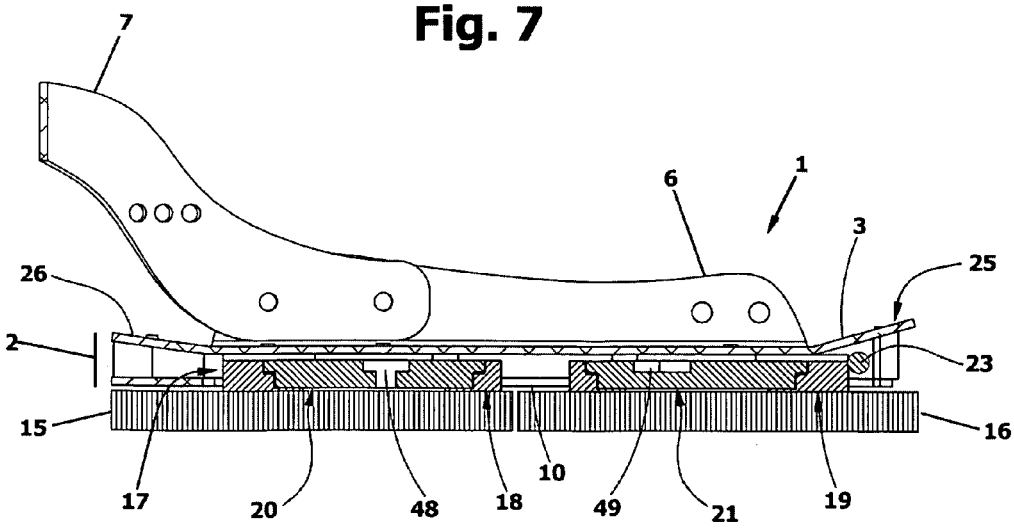
FIG. 7 is a longitudinal section, with elevation, taken as noted on FIG. 6.

Also shown in FIG. 6 is the plane of a longitudinal section taken for FIG. 7. FIG. 7 includes parts of the elevation view for clarity. In section, the box girder (1), manifested in the presently preferred embodiment as a sandwich box girder (2), is seen extend across two ski members (15, 16) and is held in place on the snowboard mounting block assembly (17). Two snowboard mounting blocks (18 and 19), one on each ski, are locked between the heel of the box girder and toe pivot and locking pin (23) underneath the toe riser (25).

The adjustment of the pucks to position and align the snowboard mounting block elements is provided for by screws in slots 48 and 49 of the sectional view (not shown: the screws mate with threaded inserts embedded in the ski members).

Figure 8:
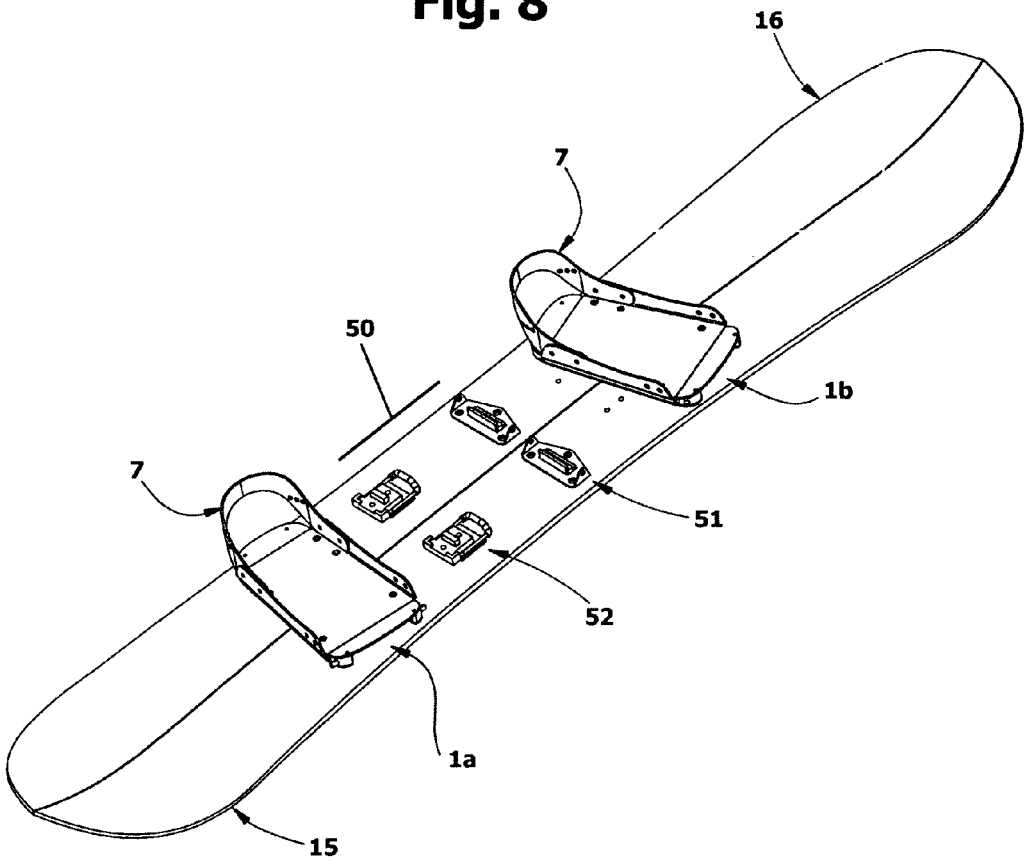
FIG. 8 is a sketch of a pair of integrated boot binding lowers, with heel cup, straddling a splitboard in snowboard riding configuration. The toe pivot and climbing bar hardware used with the boot binding lowers in ski touring configuration are also shown.

FIG. 8 shows a fully assembled splitboard of the invention, with integral boot binding lowers in the snowboard riding configuration. Two ski members (15, 16) are joined at a pair of snowboard mounting block assemblies by conjoining integral boot binding lowers with sandwich box girder construction. Heel cups (7) are shown for clarity.

Also shown are the hardware assemblies used in ski touring mode, which are more centrally placed on the ski members. Item 51 is a ski toe pivot assembly; item 52 a ski heel rest and climbing bar assembly. These two assemblies form the ski mounting assembly (50), which is used in ski touring configuration, as will be discussed next.

The user may readily remove the boot bindings from the snowboard boot mounting block assemblies and reattach them to the ski mounting assembly. The binding assemblies of the present invention permit rapid tool-free conversion from the ski mode to the snowboard mode, or vice versa.

Figure 9:
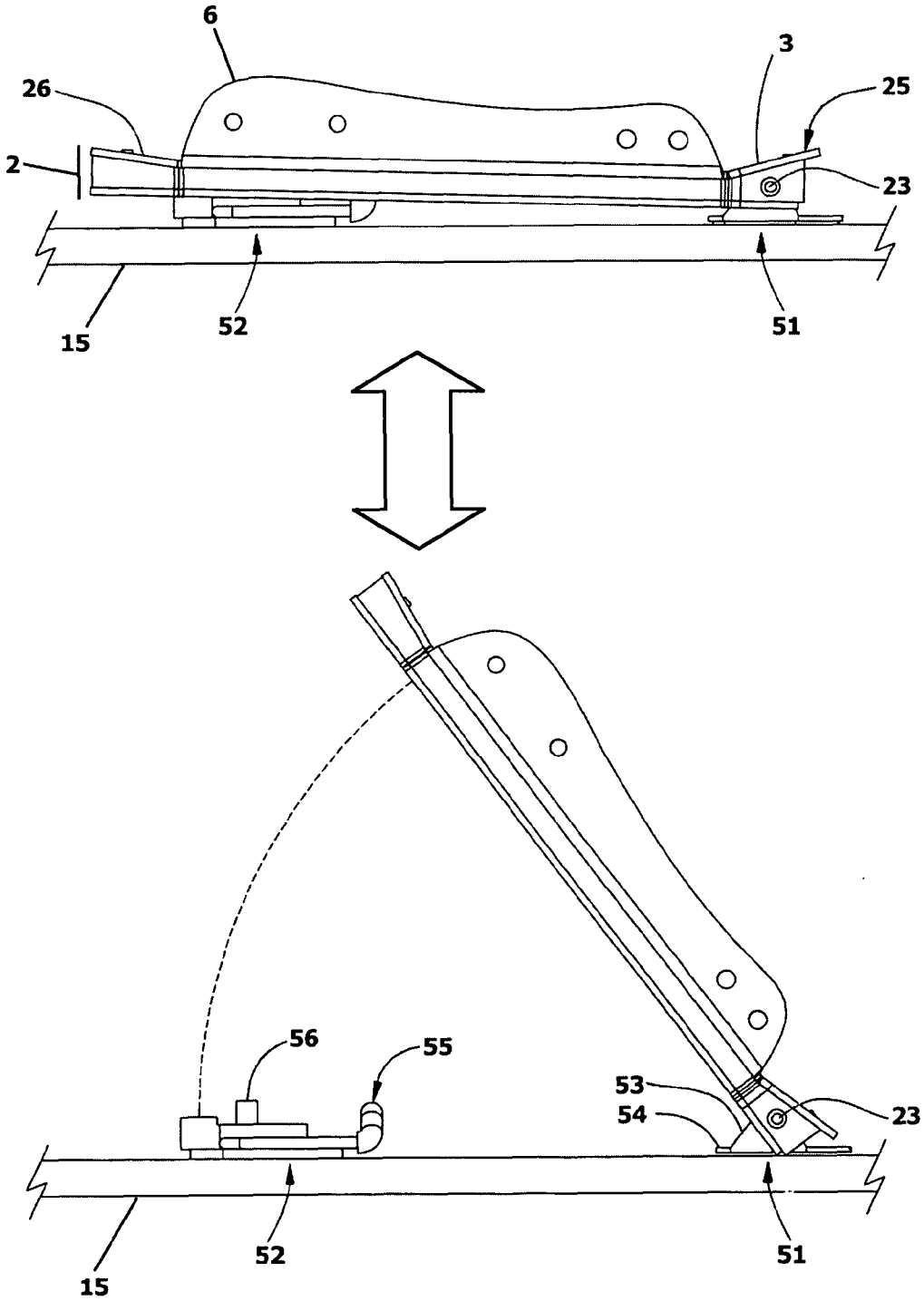
FIG. 9 is an elevation view of the free heel "telemark" pivot action of a boot binding lower of Example 1 attached to a toe pivot pin assembly.

FIG. 9 is an elevation/action view showing an integral boot binding lower of Example 1 at rest on a ski (15) in the ski mounting assembly introduced in FIG. 8. The toe of the sandwich box girder (2) is secured with a pin (23) through the webbing under the toe riser (25), which engages a toe pivot mounting cradle and block (53, 54) of the ski toe pivot assembly (51). Under the heel (26), a heel rest and climbing bar assembly (52) support the boot binding off the surface of the ski. The climbing bar assembly consists of a climbing bar (55), which is hinged, and a heel rest pad (56).

The functional mechanism is revealed in more detail in the lower panel. The skier can alternate from heel stance (as shown in the top panel) to telemark stance (as shown in the lower panel). In telemark stance, partial weight is resting on the toe pivot cradle and pin. The life and performance of this hardware is dramatically improved in the prototype of Example 1, through use of a longer pivot pin (23), the webs of UHMWPE to lubricate the pin, and a wider mounting area to distribute the weight.

Figure 10:
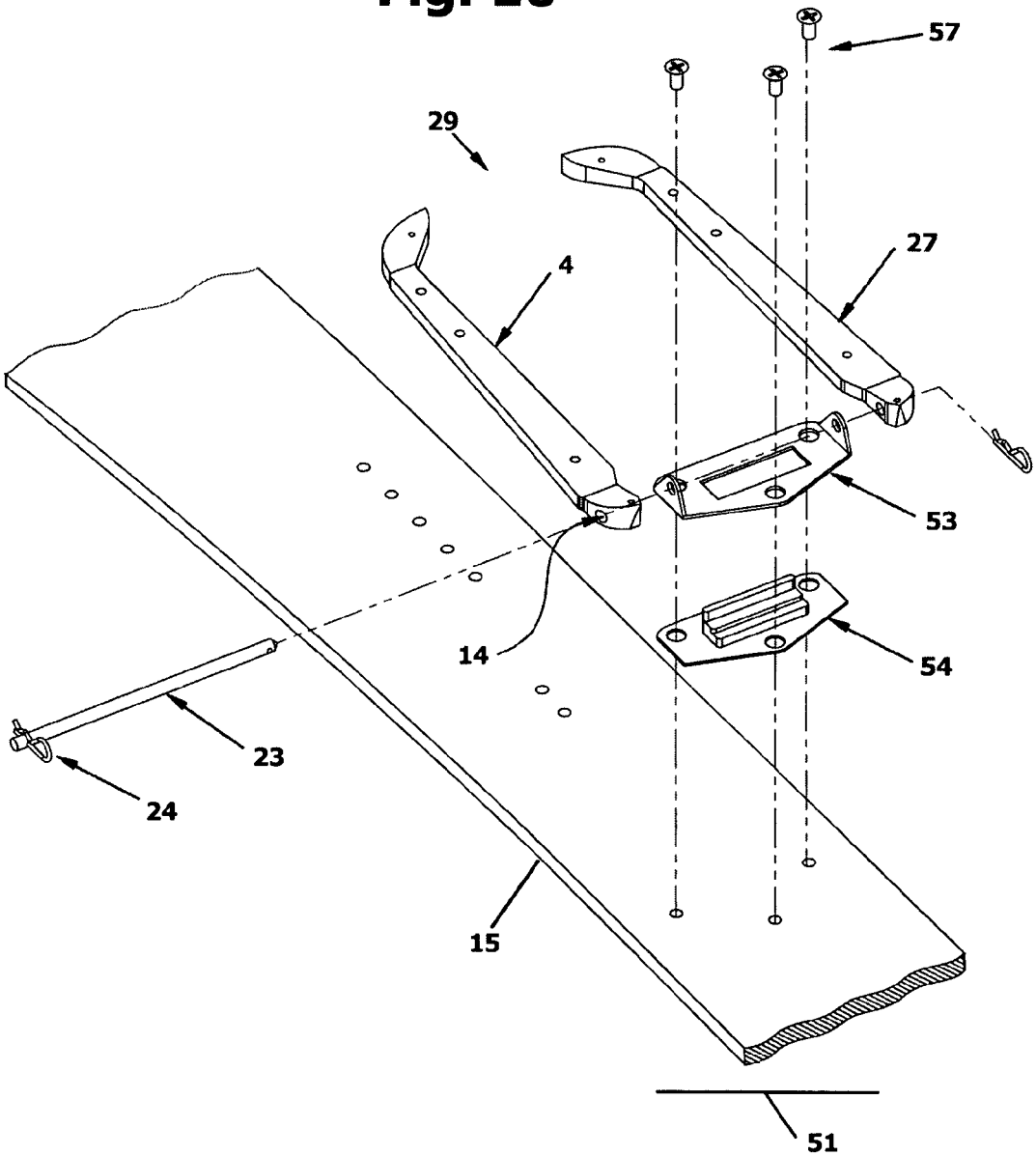
FIG. 10 is an exploded view showing a toe pivot mechanism.

In FIG. 10, an exploded view is used to better show the improvements in the toe pivot assembly (51). The two webs of the box girder (4, 27) pivot at 14 on pivot pin (23), which is clasped in place with cotter pins (24) or similar fasteners. The fulcrum of the pivot runs through toe pivot pin cradle (53), which is supported by a plastic molded block (54). The elements of the fulcrum are affixed to the ski (15) with 3 mounting fasteners (57).

Figure 11:
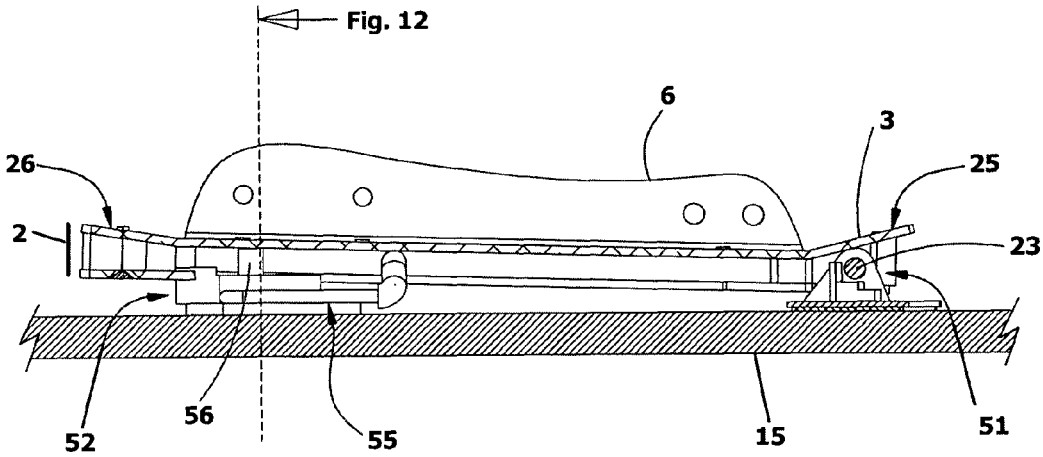
FIG. 11 shows a longitudinal section of an integrated boot binding lower mounted in ski touring mode. Shown are mechanical details of a toe pivot and climbing bar assemblies with the climbing bar down. The location of the transverse section of FIG. 12 is also shown.
Figure 12:
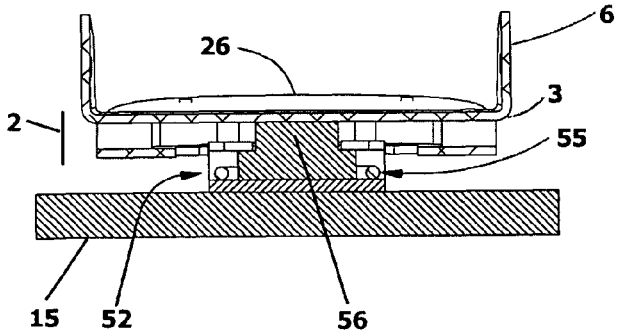
FIG. 12 shows a transverse section through the heel of a boot binding lower mounted in ski touring mode with the climbing bar down.

In FIG. 11, the elements of the ski mounting assembly are shown in longitudinal section. The location of the transverse section for FIG. 12 is also shown. The longitudinal slice cuts the ski (15) toe assembly (51) and heel assembly (52). The pivot pin or axle (23) is located in the web below toe riser (25), and is sandwiched between the bottom and top plates (3,5).

At the heel (26), climbing pin assembly 52 consists of a heel rest pad (56) and climbing bar (55). In FIG. 12, the corresponding transverse section through the heel, contact is seen between the heel rest pad and the bottom surface of the top plate (3). The heel rest lies entirely within the box-ended channel (9) of the full assembly. An indication of the hinged nature of the climbing bar is suggested.

Figure 13:
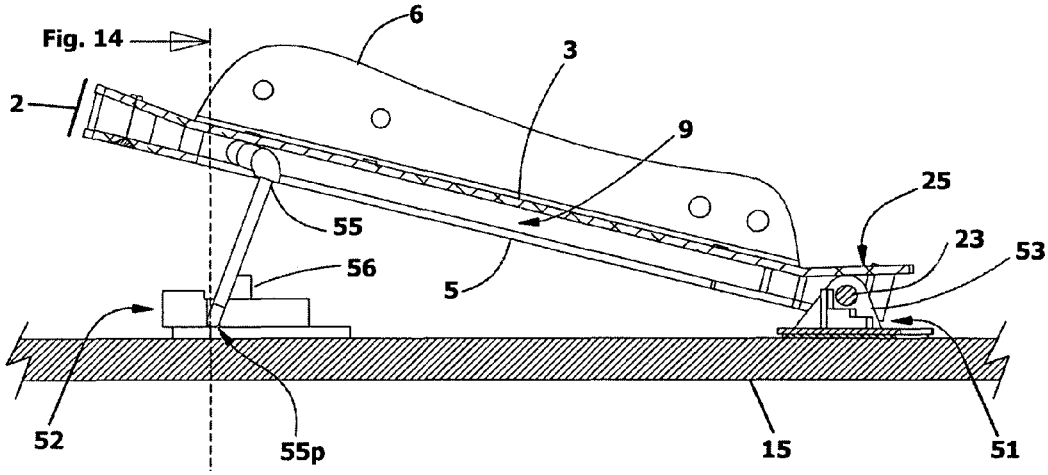
FIG. 13 shows a longitudinal section of an integrated boot binding lower mounted in ski touring mode. Shown are mechanical details of a toe pivot and climbing bar assemblies with the climbing bar up. The location of the transverse section of FIG. 14 is also shown.
Figure 14:
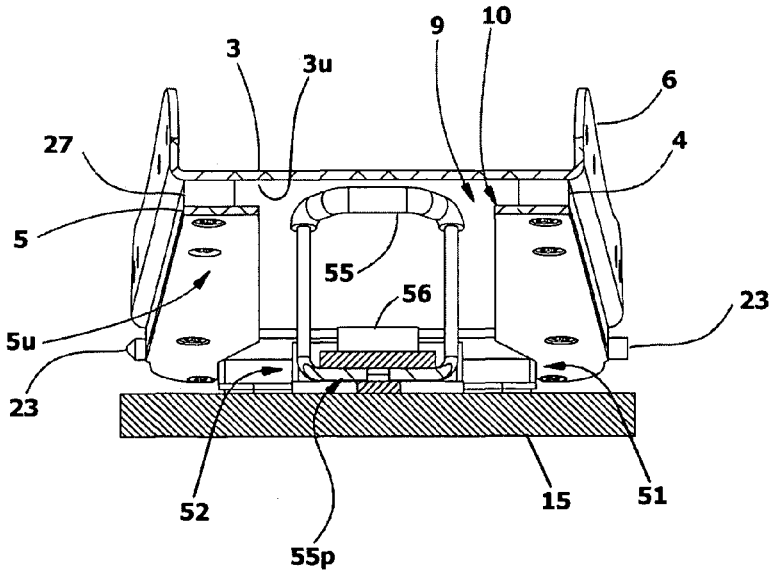
FIG. 14 shows a transverse section through the heel of a boot binding lower mounted with the climbing bar up for ski touring mode.
Figure 15:
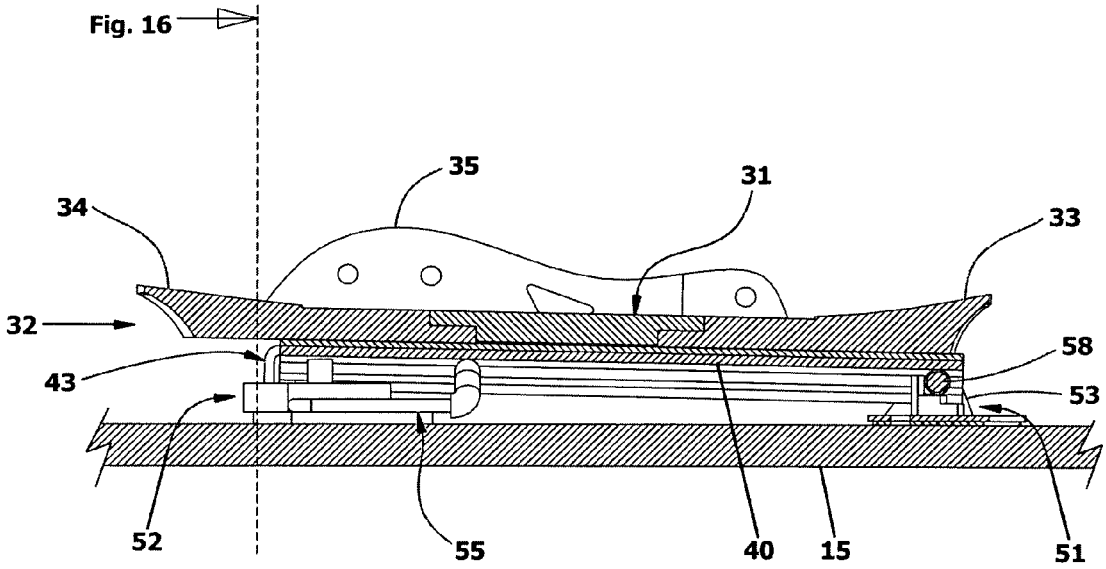
Fig. 15 (Prior Art)
FIG. 15 shows a longitudinal section of a boot binding of the prior art mounted in ski touring mode. Shown are mechanical details of the toe pivot and climbing bar assemblies with the climbing bar down. The location of the transverse section of FIG. 16 is also shown (per U.S. Pat. No. 5,984,324).

In FIGS. 13 and 14, the action of the climbing bar (55) is better illustrated. The hinge or pivot point of the climbing bar is formed by bending paired "ells" in the steel bar (55*p*) and clipping them into the base block of the climbing bar assembly, which also serves as the heel rest (56). Heel rest pad 56 squarely contacts the underside of the top plate (3*u*). The underside of the bottom plate (5*u*) extends forward and behind the climbing bar assembly without interference. Medial and lateral webs (4, 27) and toe pivot pin (23) are also shown in this cutaway view.

Figure 16:
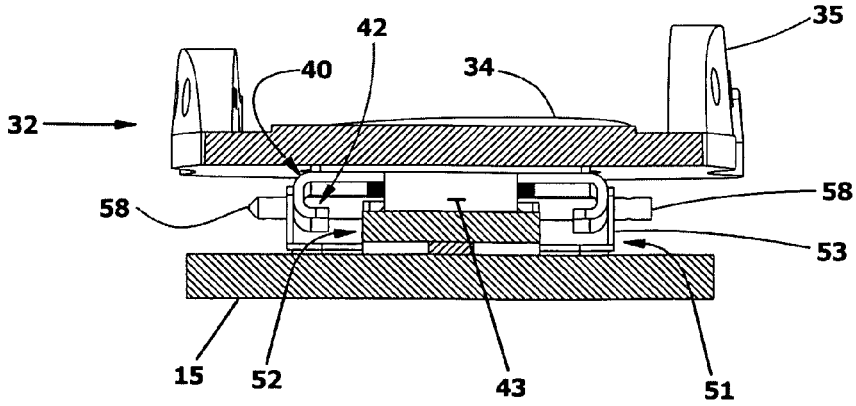
Fig. 16 (Prior Art)
FIG. 16 shows a transverse section through the heel of a boot binding base plate of the prior art mounted in ski touring mode with the climbing bar down.
Figure 17:
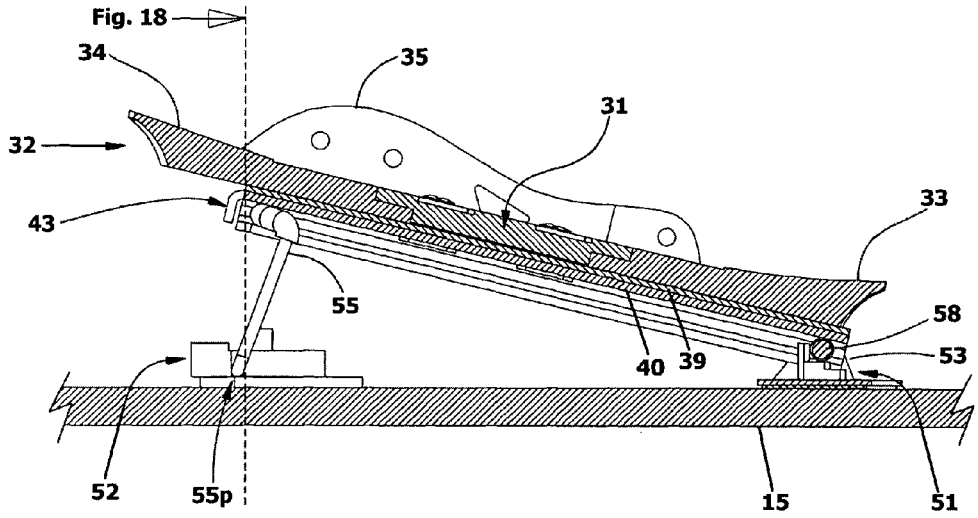
Fig. 17 (Prior Art)
FIG. 17 shows a longitudinal section of a boot binding of the prior art mounted in ski touring mode. Shown are mechanical details of the toe pivot and climbing bar assemblies with the climbing bar up. The location of the transverse section of FIG. 18 is also shown (per U.S. Pat. No. 5,984,324).

FIGS. 15 through 18 compare the ski mounting assembly of the prior art. Some elements are used in common. These include the toe pivot assembly (51) and the climbing bar assembly (52), but differences can be noted, for example by comparison of FIG. 16 with FIG. 14. Note the wider support base in FIG. 14 (Example 1) as compared to the prior art (FIG. 16). Pivot pin 58 is clearly shorter than pivot pin 23. Also note the rest point of the heel stop tab (43) of the prior art (a folded tab of metal) on a facet of the climbing bar housing (52). No other contact point is provided. Interestingly, the metal tab is prone to soften adjacent to the fold where it is work hardened and has been observed to break off with continued use.

Figure 18:
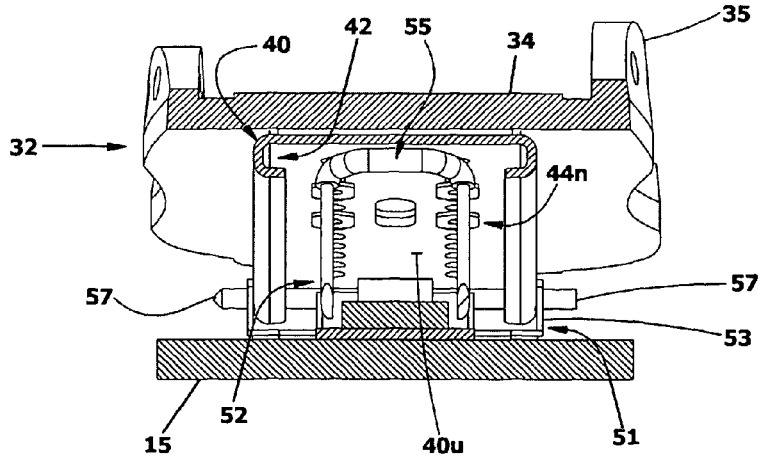
Fig. 18 (Prior Art)
FIG. 18 shows a transverse section through the heel of a boot binding base plate of the prior art mounted with the climbing bar up for ski touring mode.
Figure 19:
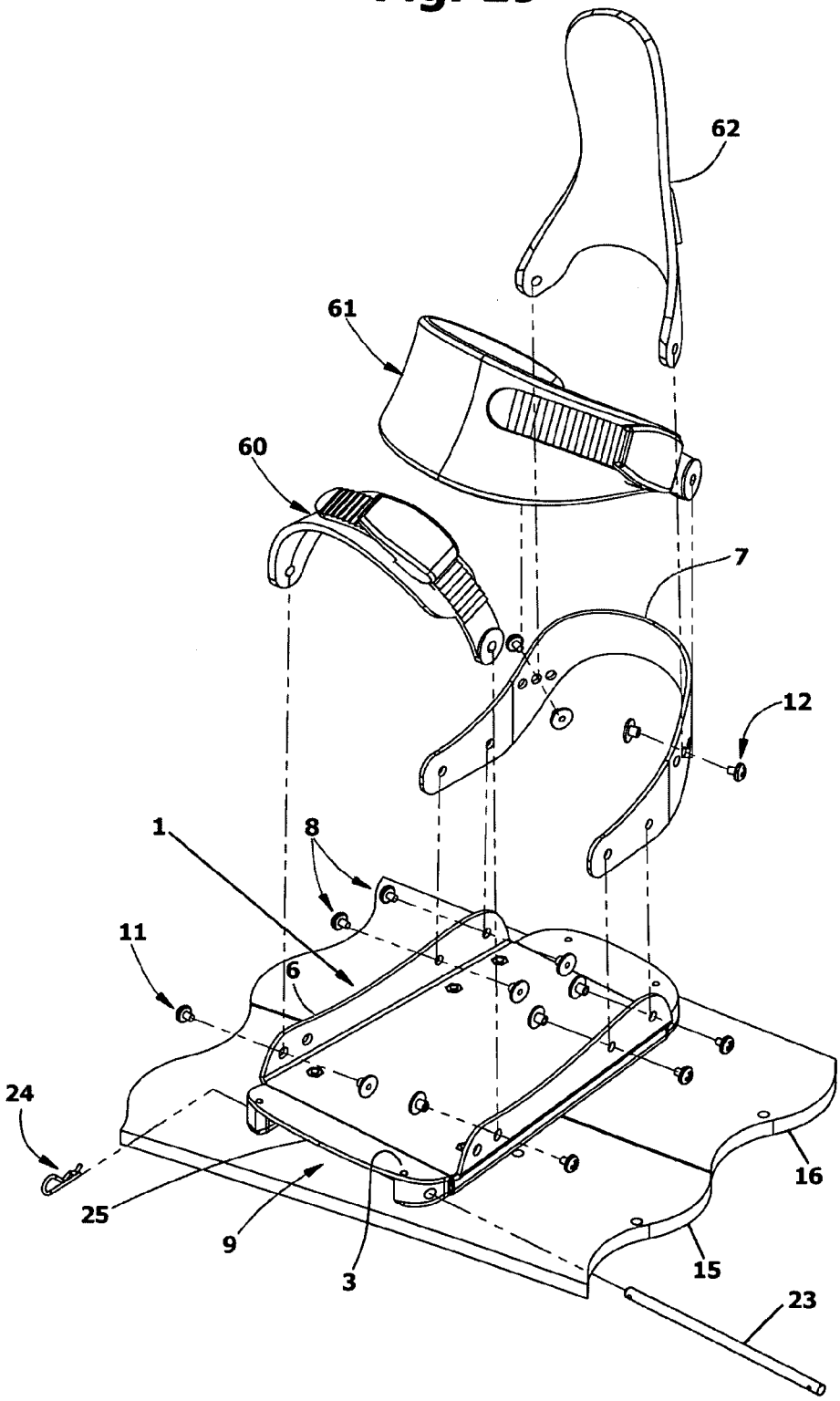
FIG. 19 is an assembly view of the typical elements of a boot binding upper on the integral boot binding lower of FIG. 3.

FIG. 18 is also instructive. When compared to FIG. 14, it is clear that the prior art boot binding, at toe stance on the climbing bar, is much higher off the board than in the mechanism of Example 1. The narrowness of the toe pivot fulcrum (51, 58) is also apparent.

FIG. 19 demonstrates how the completed boot binding of Example 1 was fabricated. The integral boot binding lower (1) is shown fully assembled, as in FIG. 3. Under it, inside box-ended channel 9, the two ski members (15, 16) are conjoined by its grip on the snowboard mounting block elements as shown in FIG. 2. The completed assembly is then locked in place with toe pivot and locking pin (23) running through the toe riser (25).

In this example, the elements of a boot binding upper consist of: heel cup (7), toe strap (60), heel strap (61), and highback (62). Fastener 12 secures the heel strap and high back to the heel cup in any of the three placement holes shown. Fasteners (8) secure the heel cup to the side rails (6) of top plate (3). Fasteners (11) secure the toe strap to the side rails.

Figure 20:
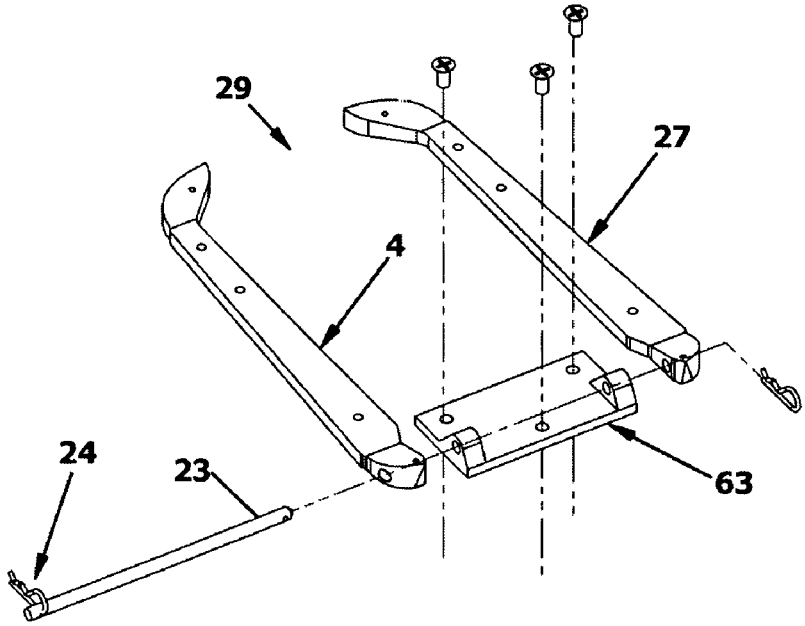
FIG. 20 is an alternate embodiment for a pivoting means of the toe pivot block assembly.

FIG. 20 illustrates an alternative embodiment of the toe pivot assembly (51) shown in FIG. 9. Here, a polyethylene block (63) is milled to perform the function of toe pivot pin fulcrum. Compare this figure with FIG. 10. Equivalent pivoting means are readily gleaned from the prior art.

Figure 21:
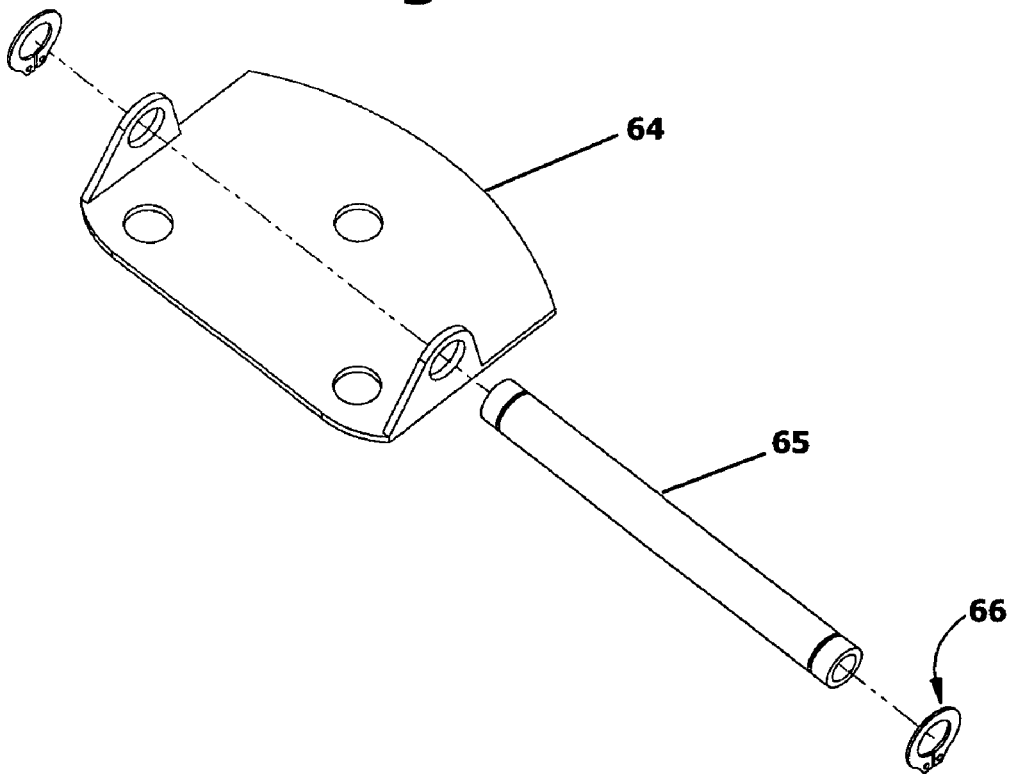
FIG. 21 is an alternate embodiment for a pivoting means of the toe pivot block assembly.

FIG. 21 illustrates an alternate embodiment of the toe pivot assembly (51) shown in FIG. 9. Here, a toe pivot pin cradle (64) contains captive bushing (65), held in place by retaining rings (66), to reduce or prevent degenerative wear of the critical toe pivot bearing surfaces.

In one embodiment, the invention is an improvement of a splitboard boot binding assembly, comprising an integral boot binding lower, said integral boot binding lower further comprising a sandwich box girder having a top plate, a bottom plate, a medial web, a lateral web, a heel end and a toe end, wherein said bottom plate comprises a box-ended channel and inside flanges for receiving and grippingly conjoining said boot binding system to a snowboard mounting block assembly affixed to a splitboard.

In other embodiments, the boot binding combination of the invention includes an integral boot binding lower for grippingly conjoining the boot binding assemblies to snowboard mounting blocks on a splitboard, and a boot binding upper—but eliminates the adaptor mounting plates of prior art designs.

In a preferred embodiment, the boot binding of the invention comprises a combination of no adaptor mounting plate, an integral boot binding lower for grippingly conjoining said boot binding system to a snowboard mounting block assembly affixed to a splitboard, and a boot binding upper, the whole combination of which provides an improved level of torsional stiffness for splitboard riders. The elimination of the adaptor mounting plate is made possible by the integration of a splitboard joining device, here the integral boot binding lower, with the upper boot bindings. Elimination of the adaptor mounting plate trims excess elastic and inelastic deformation from the boot binding system, and the combination of an integral boot binding lower with suitable boot binding uppers provides an increased level of torsional stiffness not previously available for splitboard riders.

My recognition of torsional stiffness as a performance issue for splitboard boot bindings frames the problem, and I also provide inventive solutions here. While the prototype of Example 1 has been described in detail, other designs and materials of fabrication can provide an improved level of torsional stiffness for today's splitboard riders.

Although the invention has been described in connection with certain illustrative embodiments, it should be apparent that many modifications of the present invention may be made without departing from the scope of the invention as set forth in the claims.

EXAMPLES

Example 1

A Drake F-60 snowboard binding with integral heel cup and highback was modified in a shop by removing the base plate and 4-hole disk and substituting in their place a sheet of 2.5 mm aluminum with side rails folded up to form a shallow channel for the boot.

A three dimensional CAD design was sent to a local sheetmetal house that used a CNC (computer numerically controlled) laser cutter to cut the outline and holes for the aluminum parts necessary for the bindings. Sheetmetal press brakes were then used to bend the channels of the bindings. Similarly, a CNC milling machine cut out the UHMW polyethylene spacers from a sheet of 16 mm thick plastic. This machine provided all holes, the outline, and contoured surfaces.

Using mounting bolts, the heel and toe straps and highback were secured in place. A total of 10 screws, countersunk, were placed at the circumference of the base along each side of the sandwich to secure the plastic spacer materials (webs) in position between the aluminum plates.

A milled hole accommodates a longer pivot pin than used in the prior art, and a second smaller hole was placed in the aluminum side rails to secure a braided cable loop to protect against loss of the snap fasteners. Note that the inner dimensions of the channel formed by the plastic spacers is wide enough to snugly fit over the ski mounting tabs and that the transverse pivot axis lines up with the hole in the ski mounting bracket. UHMWPE lubricates the pin and spares wear on the pivot pin cradle mount.

Right and left boot bindings were made in this manner. To assemble the snowboard, the boot bindings are securely slid over the snowboard mounting blocks and locked in place with a transverse pin and snap fasteners. To switch to ski mode, the boot bindings are slipped off the snowboard mounting block assemblies and positioned at the toe over the ski mounting brackets so that the pivot pin can be aligned through the pivot holes and secured in place with snap fasteners.

Example 2

Mechanical comparisions were made using a splitboard and boot binding assembly of the prior art versus that of Example 1. A Voile "Splitdecision 166" splitboard was used for the comparisons, and for the prior art testing, Drake F-60 snowboard bindings were mounted as recommended by the manufacturer on the Voile mounting hardware. The boot bindings were assembled in snowboard riding configuration for these comparisons.

Physical measurements of the two boot bindings were also made and are recorded in Table 1.

TABLE 1

| | Prior Art | Example 1 |
|---|---|---|
| Distance from plane of board to bottom of boot | 26 mm | 14 mm |
| Width in contact with board under lateral load | 80 mm | 120 mm |
| Weight per boot binding | 1182 g | 1015 g |

To measure deformation under lateral strain, which is related to spring constant K of the boot bindings, the snowboard was clamped to a vertical surface so that the highback of the boot bindings were mounted parallel to the floor. An 11.3 kg weight was then clipped onto the top of the highback, and the angle of shear for the two assemblies was compared. Deformation under modest lateral loading was approximately 36% greater with the prior art boot binding, indicating an unacceptably low torsional stiffness.

The binding system of the new invention was noted to substantially increase lateral stiffness of the boot and to lower the center of gravity on the boot. In snowboarding tests undertaken under winter conditions on mountainous terrain, the increased lateral rigidity of the inventive bindings was found to result in immediately noticeable increases in control and responsiveness of the board in downhill ride mode.

Improvements were also noted in telemark ski touring, which were attributed to the improved toe contact made by the boot with the board, particularly for kick turning.

Weight is reduced by 6 ounces (170 g) on each foot, a 15% weight savings. This weight savings noticeably decreases the effort required to ascend a slope because the weight on each foot must be repeatedly lifted and pushed forward. Weight on the feet requires roughly five times the exertion to move as the same weight carried in a backpack. The weight savings is had by combining structures such as the baseplate and the slider plate, the original slider plate being nearly wide enough to be a binding baseplate. This savings is also had by eliminating unnecessary structures like the four hole disk (shown in FIGS. 4 and 17, item 31). The disk adds the ability to adjust the stance angle on a conventional snowboard and is the principal component that determines the thickness of the baseplate. However, with a splitboard, the plastic pucks also allow rotation of stance during setup, making the adjustability of the 4-hole disk redundant. Voile (Salt Lake City, Utah) states that the binding should always be connected to the slider at zero degrees. The prototype fuses these structures at zero degrees without the added weight and thickness of a four hole disk.

Example 3

A block of UHMWPE, 25 mm thick by 100 mm by 75 mm, is trimmed to fit between the lateral and medial spacers of an integral boot binding lower of FIG. 10. The rear height of the block is trimmed and rounded to fit easily under the toe riser. A thin rectangular pad is formed from the front of the block to protect the board surface from abrasion by the toe riser and serve as a shim during telemark ski touring. Using the boot bindings toe pivot holes of Example 1 as a drill guide, a transverse hole through the block is made. This hole is dimensioned to accept a captive bushing (see for example FIG. 21) for use with the longer toe pivot pins. Board mounting holes are also drilled and countersunk, so that the new toe mounting assembly can be fitted onto the existing inserts of the board. A second block is shaped for the other board. These components go into a boot binding interface conversion kit, or "split kit", for use with the integral boot binding lower of the invention.

TABLE 2

| Splitboard Boot Binding Interface Conversion Kit | |
|---|---|
| Fusion boot binding (with integral boot binding lower of Example 1) | pair |
| Ski 3-Hole Mounting Bracket w/captive bushing (shims available in 2 mm increments) | 2 ea |
| 20 mm stainless steel screws | 6 ea |
| Heel rest with climbing bar | 2 ea |
| Pivot pin and easy-snap retainer ring with runaway cable | 2 ea |
| 30 mm stainless steel screws | 8 ea |
| Crampons with fasteners | 2 ea |
| Allen wrench | 1 ea |

Note:
Conversion kits compatible with Voile "universal slider tracks" (Voile-USA: Salt Lake City, UT). Snowboard mounting block assemblies are optional and may be customized by the user.

The foregoing written description has disclosed certain embodiments illustrative of the engineering principles, materials properties, and inventive steps used to solve the problems addressed by the invention. The invention, however, is not limited to the exact construction, materials and operation shown and described herein; but also includes such variants, as will be apparent after study of these teachings, to those skilled in the art.

The invention claimed is:

1. A pair of boot bindings, each binding of said pair comprising a box girder having a top plate with a top surface, a bottom plate with a bottom surface and outside lower edges, a medial web member, a lateral web member, a heel end and a toe end, wherein:

a) said bottom plate comprises a channel with parallel inside flanges for receiving and grippingly conjoining said box girder to a snowboard mounting block assembly affixed to a splitboard;

b) said medial and lateral web members underlie said top plate and join said top plate to said bottom plate;

c) said medial and lateral web members each comprise a transverse coaxial hole on a pivot axis proximate to said toe end, said transverse coaxial hole for receiving an insertable toe pivot pin;

d) said medial and lateral web members have each a lateral face and a medial face dimensionally separated by a lateral-to-medial width, said width having a maximum proximate to said toe end and tapered to a minimum posteriorly from said toe end, and a superior aspect and an inferior aspect dimensionally separated by a superior-to-inferior height, said height having a maximum proximate to said toe end and sloping to a minimum posteriorly from said toe end; and e) said top surface of said box girder is sloped and tapered, said slope and taper for contactingly supporting the underside contour of a boot sole of a soft boot.

2. The pair of boot bindings of claim 1, further wherein said height of each said web member is characterized by a minimum in height intermediate between said toe end and said heel end.

3. The pair of boot bindings of claim 1, further wherein each said web member is dimensioned with a height having a rising slope at the heel end for supporting a heel riser.

4. The pair of boot bindings of claim 1, further wherein said top plate comprises tabs upwardly folded to form side rail, heel cup, brace, or bracket.

5. The pair of boot bindings of claim 4, each binding of said pair further comprising a member or members of a boot binding upper selected from heel cup, highback, brace, arch support, heel riser, exterior shell, heel strap, toe strap and step-in binding, wherein said member or members of said boot binding upper are configured for attachment to said box girder.

6. A boot bindings kit for a splitboard, comprising said pair of boot bindings of claim 1 and a pair of toe pivot pins with toe pivot pin bushings.

7. The boot bindings kit of claim 6, further comprising a toe pivot mounting cradle.

8. The boot bindings kit of claim 6, further comprising a pair of snowboard mounting block assemblies.

9. The pair of boot bindings of claim 1, wherein said channel in said bottom plate is a box channel with posterior snow vent.

10. The pair of boot bindings of claim 9, wherein said heel ends of said lateral and medial web members are formed having convergingly directed projections impinging on said channel.

11. A combination of a splitboard and a pair of boot bindings, said splitboard comprising:

a) a pair of ski members, said ski members having a snowboard riding configuration and a ski touring configuration;

b) a pair of snowboard mounting block assemblies for use in said snowboard riding configuration;

c) a pair of ski mounting assemblies for use in said ski touring configuration;

each boot binding of said pair comprising a box girder having having a top plate with a top surface, a bottom plate with a bottom surface and outside lower edges, a medial web member, a lateral web member, a heel end and a toe end, wherein:

i) said bottom plate comprises a channel with parallel inside flanges for receiving and grippingly conjoining said box girder to a snowboard mounting block assembly affixed to a splitboard; ii) said medial and lateral web members underlie said top plate and join said top plate to said bottom plate; iii) said medial and lateral web members each comprise a transverse coaxial hole on a pivot axis proximate to said toe end, said transverse coaxial hole for receiving an insertable toe pivot pin; iv) said medial and lateral web members have each a medial face and a lateral face dimensionally separated by a lateral-to-medial width, said width having a maximum proximate to said toe end and tapered to a minimum posteriorly from said toe end, and a superior aspect and an inferior aspect dimensionally separated by a superior-to-inferior height, said height having a maximum proximate to said toe end and sloping to a minimum posteriorly from said toe end; and v) said top surface of said box girder is complexedly sloped and tapered from toe to heel, said complex slope and taper for contactingly supporting the contoured underside of a boot sole of a soft boot.

12. A splitboard combination comprising:

a) a first ski member having at least one nonlinear longitudinal edge;

b) a second ski member having at least one nonlinear longitudinal edge;

c) conjoining apparatus for securing said first ski member to said second ski member to form a snowboard having nonlinear longitudinal edges;

d) a ski mounting assembly secured to said first ski member and a ski mounting assembly secured to said second ski member;

e) a first snowboard mounting block assembly positioned to extend a first boot binding between said first ski member and said second ski member, said first snowboard binding block assembly having at least one snowboard mounting block element secured to said first ski member and at least one snowboard mounting block element secured to said second ski member;

f) a second snowboard mounting block assembly positioned to extend a second boot binding between said first ski member and said second ski member, said second snowboard mounting block assembly having at least one snowboard mounting block element secured to said first ski member and at least one snowboard mounting block element secured to said second ski member;

g) each boot binding of said pair comprising a box girder having having a top plate with a top surface, a bottom plate with a bottom surface and outside lower edges, a medial web member, a lateral web member, a heel end and a toe end, wherein:

i) said bottom plate comprises a channel with parallel inside flanges for receiving and grippingly conjoining said box girder to a snowboard mounting block assembly affixed to a splitboard; ii) said medial and lateral web members underlie said top plate and join said top plate to said bottom plate; iii) said medial and lateral web members each comprise a transverse coaxial hole on a pivot axis proximate to said toe end, said transverse coaxial hole for receiving an insertable toe pivot pin; iv) said medial and lateral web members have each a lateral face and a medial face dimensionally separated by a lateral-to-medial width, said width having a maximum proximate to said toe end and tapered to a minimum posteriorly from said toe end, and a superior aspect and an inferior aspect dimensionally separated by a superior-to-inferior height, said height having a maximum proximate to said toe end and sloping to a minimum posteriorly from said toe end; and v) said top surface of said box girder is sloped and tapered, said slope and taper for contactingly supporting the underside contour of a boot sole of a soft boot.

* * * * *